US011381019B2

(12) United States Patent
Morita et al.

(10) Patent No.: US 11,381,019 B2
(45) Date of Patent: Jul. 5, 2022

(54) CONNECTOR AND ELECTRONIC DEVICE

(71) Applicant: KYOCERA CORPORATION, Kyoto (JP)

(72) Inventors: Shunsuke Morita, Yokohama (JP); Masayoshi Kakino, Yokohama (JP); Masashi Kakeno, Yokohama (JP)

(73) Assignee: KYOCERA CORPORATION, Kyoto (JP)

( * ) Notice: Subject to any disclaimer, the term of this patent is extended or adjusted under 35 U.S.C. 154(b) by 0 days.

(21) Appl. No.: 16/499,835

(22) PCT Filed: Mar. 4, 2019

(86) PCT No.: PCT/JP2019/008425
§ 371 (c)(1),
(2) Date: Sep. 30, 2019

(87) PCT Pub. No.: WO2019/188021
PCT Pub. Date: Oct. 3, 2019

(65) Prior Publication Data

US 2021/0408707 A1 Dec. 30, 2021

(30) Foreign Application Priority Data

Mar. 26, 2018 (JP) ..... JP2018-058870

(51) Int. Cl.
*H01R 12/91* (2011.01)
*H01R 12/71* (2011.01)
(Continued)

(52) U.S. Cl.
CPC ..... *H01R 12/91* (2013.01); *H01R 12/716* (2013.01); *H01R 13/24* (2013.01); *H01R 13/6474* (2013.01)

(58) Field of Classification Search
CPC ..... H01R 13/6315; H01R 13/24; H01R 13/6474; H01R 12/91; H01R 12/716
(Continued)

(56) References Cited

U.S. PATENT DOCUMENTS 6,394,823 B1 * 5/2002 Dunham ..... H01R 13/6474 439/108
7,125,260 B2 * 10/2006 Orita ..... H01R 12/716 439/74
(Continued)

FOREIGN PATENT DOCUMENTS

CN 104347993 A 2/2015
EP 2835874 A1 2/2015
(Continued)

*Primary Examiner* — Gary F Paumen
(74) *Attorney, Agent, or Firm* — Duane Morris LLP

(57) ABSTRACT

A connector (10) according to the present disclosure is the connector (10) to be fitted to a connection object (60) and includes a first insulator (20), a second insulator (30) movable relative to the first insulator (20), and a plurality of arranged contacts (50) attached to the first insulator (20) and the second insulator (30). Each of the contacts (50) includes a wide portion located on at least one of a first insulator side and a second insulator side. The wide portion protrudes from another portion of each of the contacts (50) that extends along one of the insulators where the wide portion is located toward the other insulator in a direction substantially orthogonal to an arrangement direction of the contacts (50).

7 Claims, 18 Drawing Sheets

(51) Int. Cl.
*H01R 13/24* (2006.01)
*H01R 13/6474* (2011.01)

(58) Field of Classification Search
USPC ..... 439/247, 248
See application file for complete search history.

(56) References Cited

U.S. PATENT DOCUMENTS

| | | | | |
|---|---|---|---|---|
| 7,922,539 | B2 * | 4/2011 | Kubo | H01R 13/6477 439/620.21 |
| 9,022,811 | B2 | 5/2015 | Takaki | |
| 2006/0089018 | A1 | 4/2006 | Orita | |
| 2012/0003875 | A1 * | 1/2012 | Akai | H01R 13/506 439/660 |
| 2015/0044917 | A1 | 2/2015 | Takaki | |
| 2017/0170588 | A1 * | 6/2017 | Doi | H01R 13/502 |
| 2019/0334288 | A1 * | 10/2019 | Horii | H01R 13/6315 |

FOREIGN PATENT DOCUMENTS

| | | | |
|---|---|---|---|
| JP | H10326651 | A | 12/1998 |
| JP | 2006185851 | A | 7/2006 |
| JP | 2006286530 | A | 10/2006 |
| JP | 2010035352 | A | 2/2010 |
| JP | 2015-35407 | A | 2/2015 |
| WO | 2018034325 | A1 | 2/2018 |

* cited by examiner

CONNECTOR AND ELECTRONIC DEVICE

CROSS REFERENCE TO RELATED APPLICATION

The present application claims priority to PCT international application PCT/JP2019/008425, filed on Mar. 4, 2019 and claims priority to and the benefit of Japanese Patent Application No. 2018-058870 filed on Mar. 26, 2018, the entire contents of each are incorporated herein by reference.

TECHNICAL FIELD

The present disclosure relates to a connector and an electronic device.

BACKGROUND

As a technique for improving connection reliability with a connection object, connectors having, for example, a floating structure in which a deviation between circuit boards is accommodated by movement of a portion of the connector during and after fitting are known.

PTL 1 set forth below discloses an electrical connector that has a floating structure and enables high-speed transmission that meets the HDMI standard.

CITATION LIST

Patent Literature

PTL 1: JP-A-2015-035407

SUMMARY

A connector according to an embodiment of the present disclosure is a connector to be fitted to a connection object and includes a first insulator, a second insulator that is movable relative to the first insulator, and a plurality of arranged contacts attached to the first insulator and the second insulator. Each of the contacts includes a wide portion located on at least one of a first insulator side and a second insulator side. The wide portion protrudes from another portion of each of the contacts that extends along one of the insulators where the wide portion is located toward the other insulator in a direction substantially orthogonal to an arrangement direction of the contacts.

DETAILED DESCRIPTION

Figure 1:
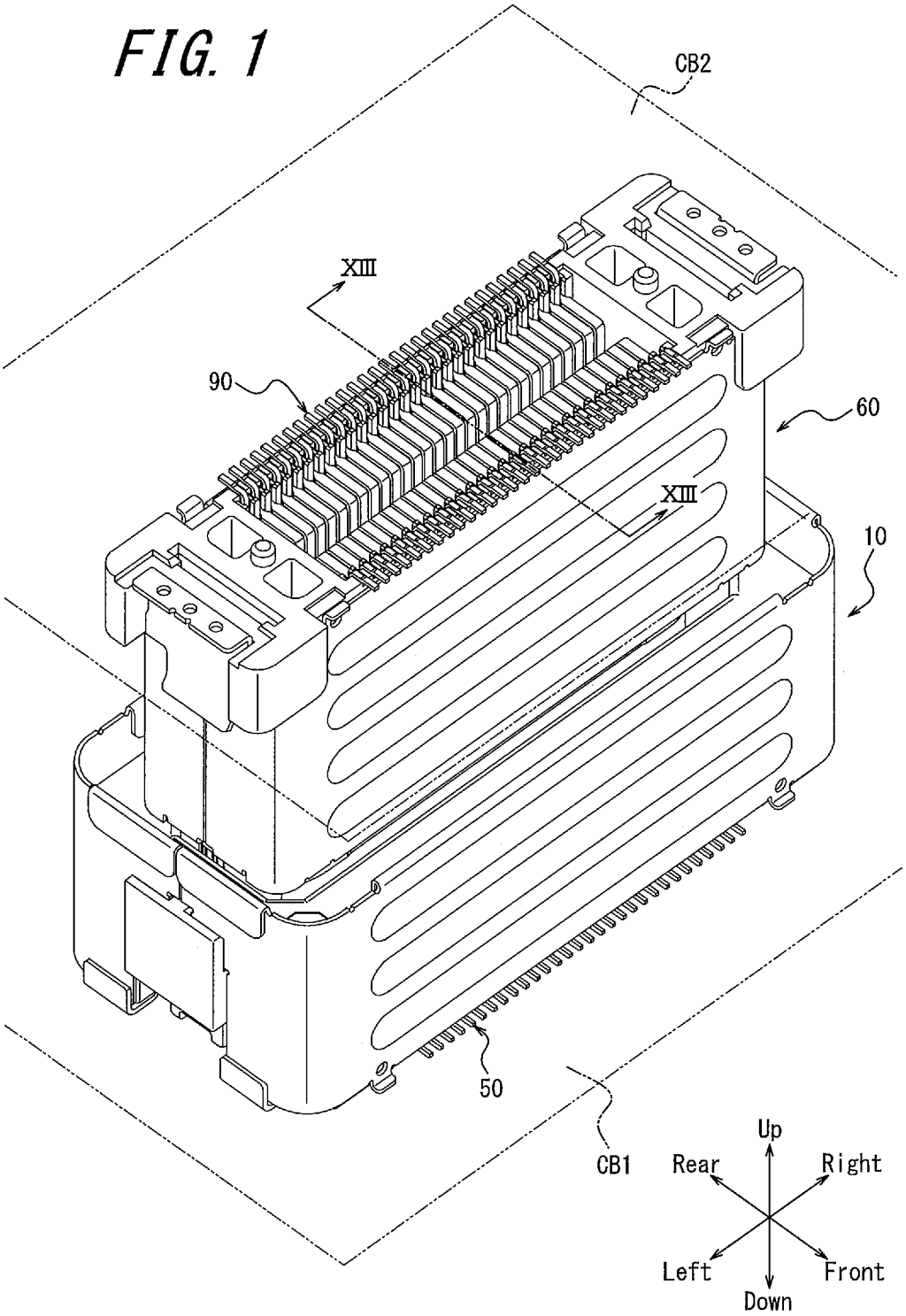
FIG. 1 is an external top perspective view illustrating a state in which a connector according to an embodiment and a connection object are connected to each other.

In recent years, increases in information amount and signal transmission speed have progressed at a remarkable rate. In connectors having floating structures, designs for supporting such high capacity and high speed transmission are desired.

According to the disclosure described in the PTL 1 set forth above, an example ideal value of a characteristic impedance is set to 100Ω. In some cases, however, an ideal value of the characteristic impedance needs to be lower than that to improve the transmission characteristics of high speed transmission. In such cases, the electrical connector described in PTL 1 cannot obtain satisfactory transmission characteristics.

A connector according to one embodiment of the present disclosure has excellent transmission characteristics for signal transmission.

Hereinafter, an embodiment of the present disclosure will be described with reference to the accompanying drawings. Terms such as "front-rear direction", "left-right direction", and "up-down direction" used herein correspond to the directions indicated by arrows in the drawings. The directions indicated by the arrows in FIG. 1 to FIG. 9, FIG. 13, and FIG. 16A to FIG. 16D correspond with each other. Similarly, the directions indicated by the arrows in FIG. 14 and FIG. 15 correspond with each other. In some figures, circuit boards CB1 and CB2 are omitted for the purpose of simplification.

Figure 2:
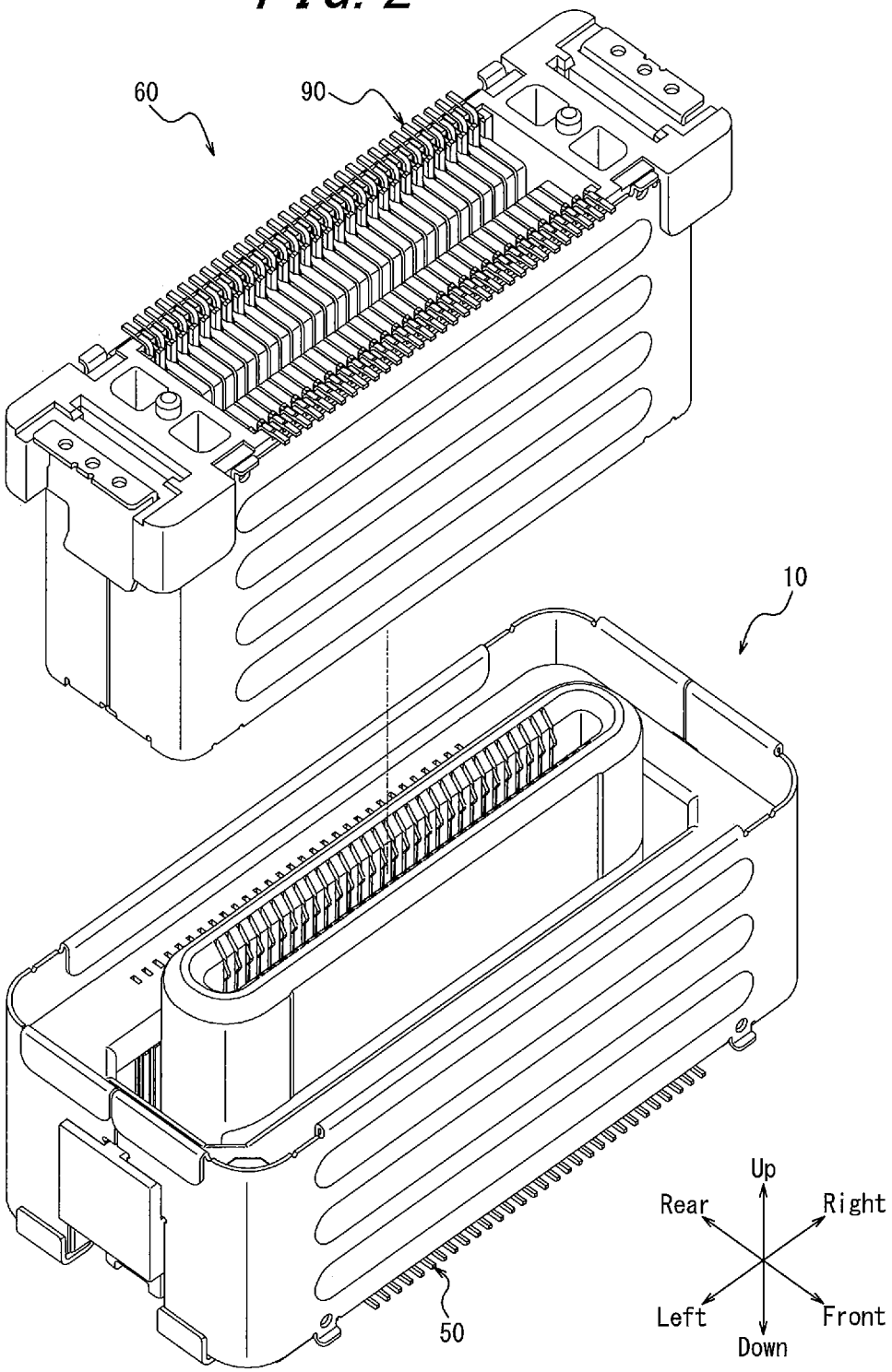
FIG. 2 is an external top perspective view illustrating a state in which the connector according to the embodiment and the connection object are separated from each other.

FIG. 1 is an external top perspective view illustrating a state in which the connector 10 according to an embodiment and the connection object 60 are connected to each other. FIG. 2 is an external top perspective view illustrating a state in which the connector 10 according to the present embodiment and the connection object 60 are separated from each other.

In the following description, it is assumed that the connector 10 according to the embodiment is a receptacle connector and the connection object 60 is a plug connector. In particular, the connector 10 is a receptacle connector in which contacts 50 elastically deform when the connector 10 and the connection object 60 are to be connected, and the connection object 60 is a plug connector in which contacts 90 do not elastically deform. Further variants of the connector 10 and the connection object 60 are not limited to this configuration. The connector 10 and the connection object 60 may function as the plug connector and the receptacle connector, respectively.

In the following description, it is assumed that the connector 10 and the connection object 60 are mounted on the circuit board CB1 and the circuit board CB2, respectively, and connected to the circuit boards in a direction perpendicular thereto. In particular, the connector 10 and the connection object 60 are connected to each other along the up-down direction, by way of example. However, the manner by which the connector 10 and the connection object 60 are connected to each other is not limited thereto. The connector 10 and the connection object 60 may be connected parallel to the circuit board CB1 and the circuit board CB2, respectively. Alternatively, one of the connector 10 and the connection object 60 may be connected perpendicular to the corresponding circuit board while the other is connected in parallel to the corresponding circuit board.

The circuit boards CB1 and CB2 may be rigid boards or any other circuit boards. For example, the circuit board CB1 or the circuit board CB2 may be a flexible printed circuit board (FPC).

The term "fitting direction" used in the following description refers to the up-down direction, by way of example. The term "fitting side" refers to an upper side, by way of example. The term "arrangement direction of contacts 50" refers to the left-right direction, by way of example. The term "direction substantially orthogonal to the arrangement direction of the contacts 50" refers to the front-rear direction and a direction approximate thereto.

The connector 10 according to the present embodiment has a floating structure. The connector 10 allows relative movement of the connection object 60 connected thereto with respect to the circuit board CB1. The connection object 60 connected to the connector 10 may move within a predetermined range with respect to the circuit board CB1.

Figure 3:
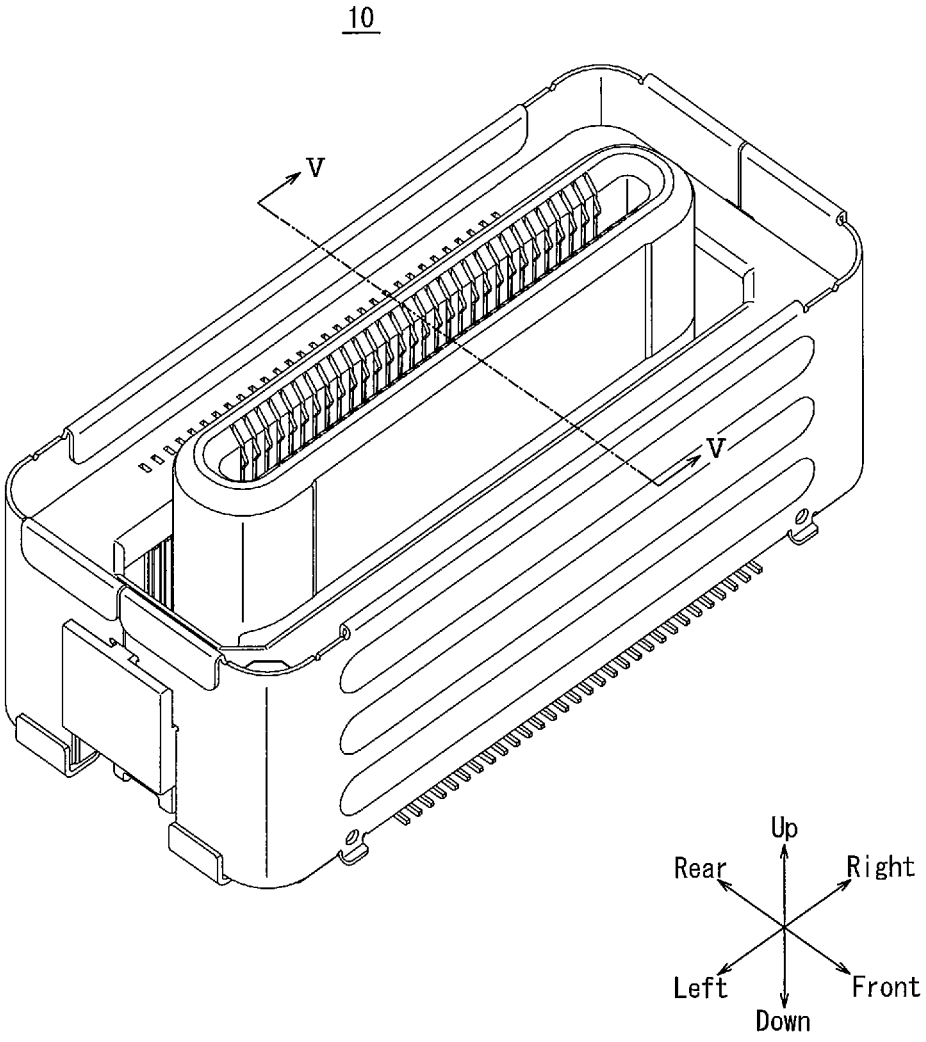
FIG. 3 is an external top perspective view illustrating the connector according to the embodiment.
Figure 4:
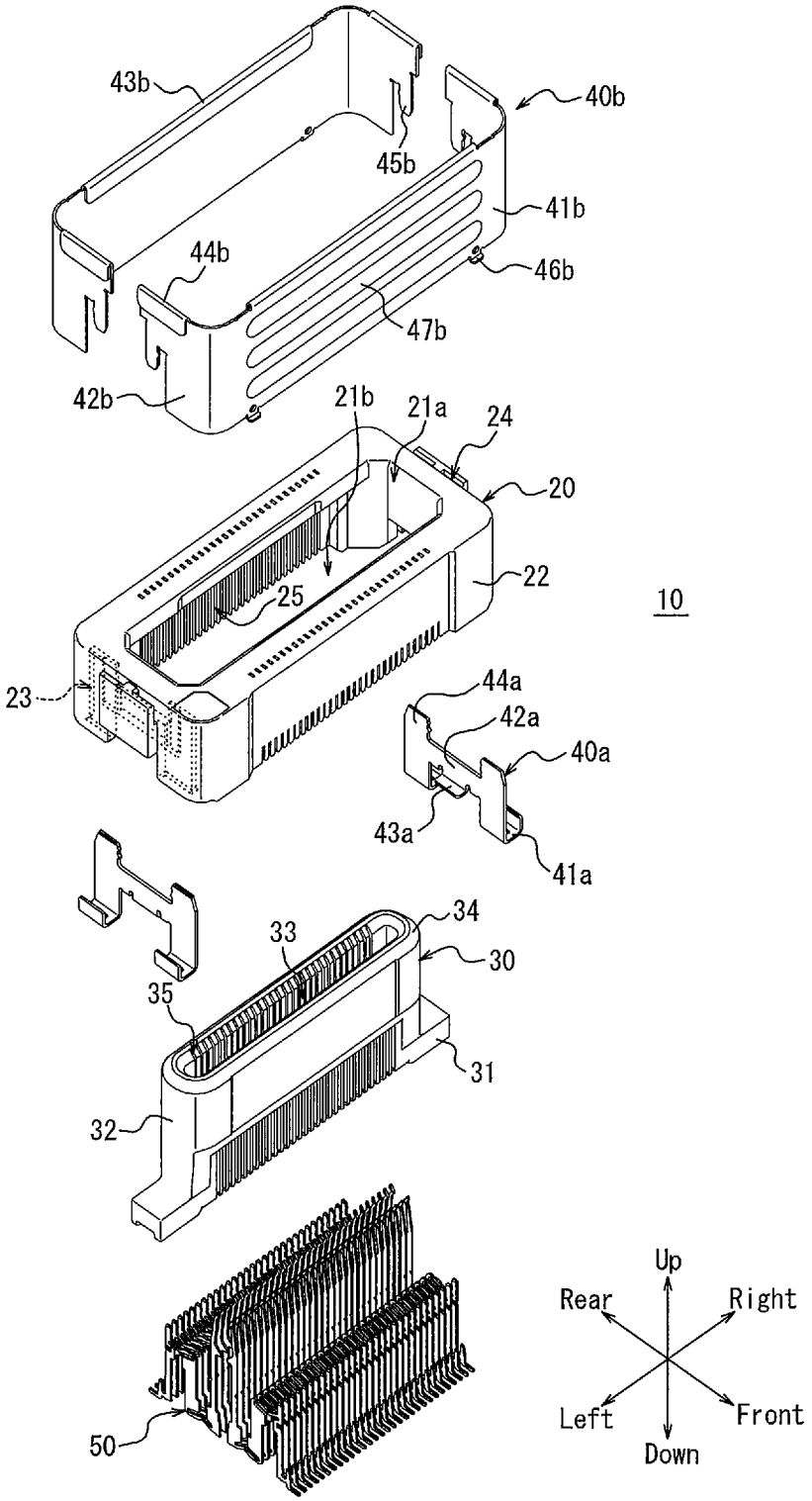
FIG. 4 is an exploded top perspective view of the connector of FIG. 3.
Figure 5:
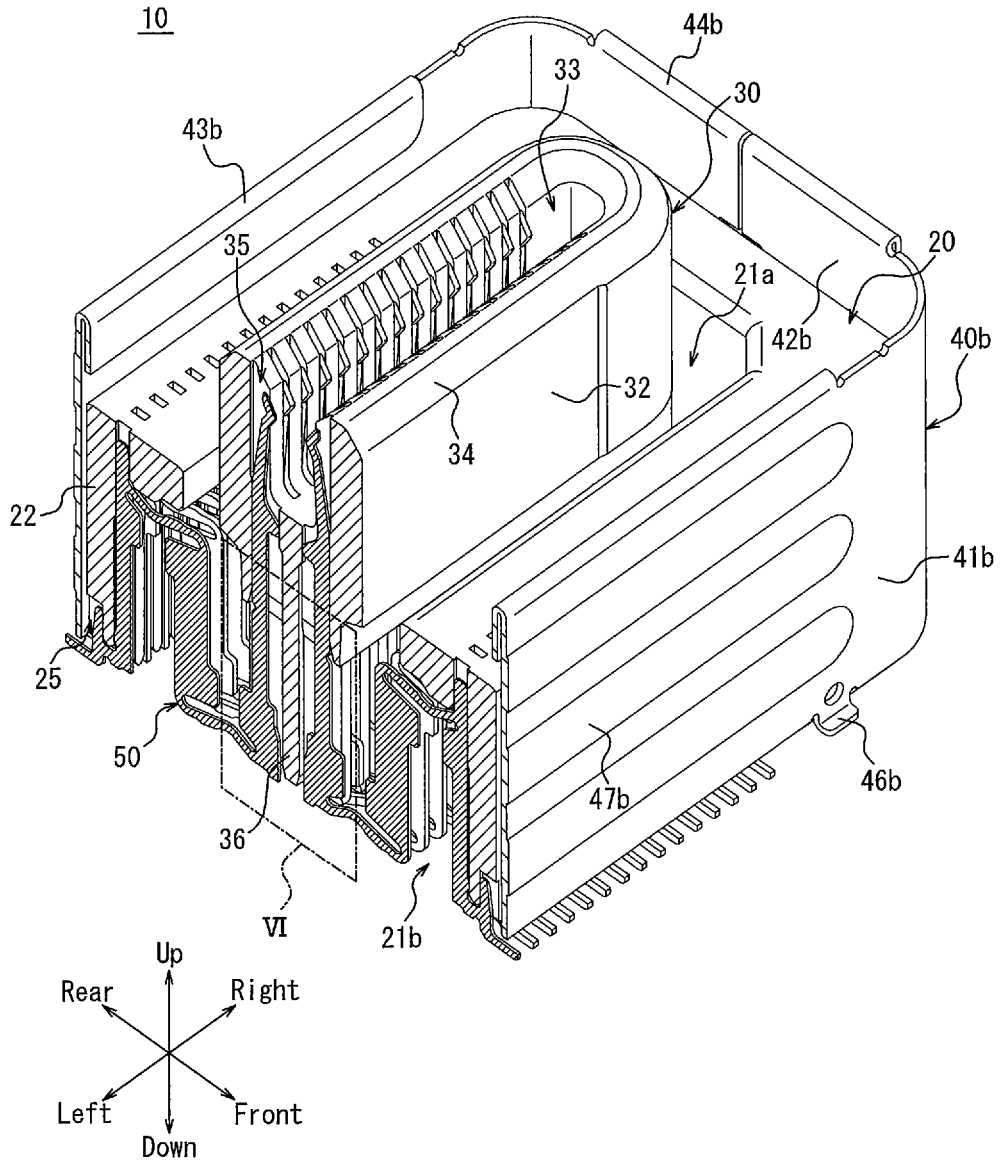
FIG. 5 is a cross-sectional perspective view taken from arrow V-V of FIG. 3.
Figure 6:
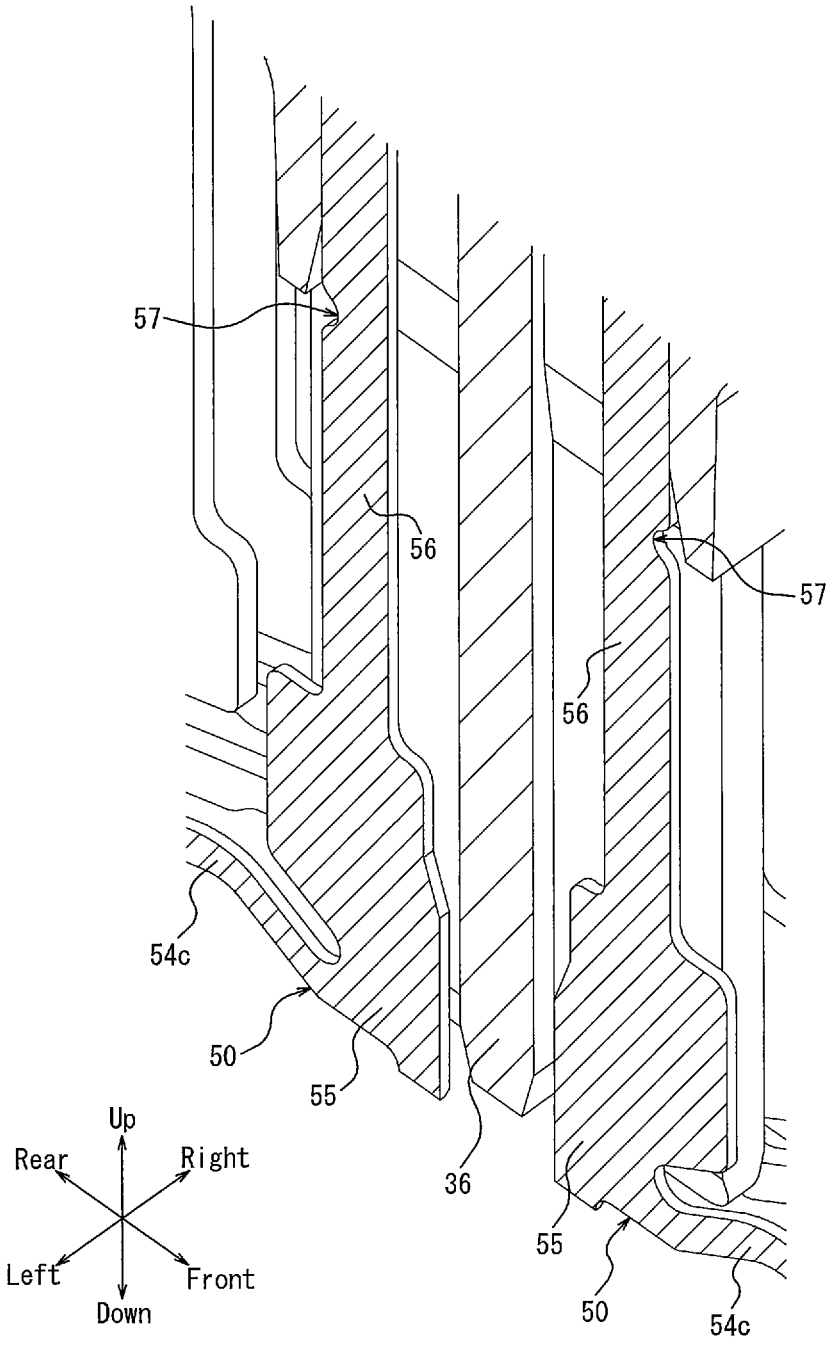
FIG. 6 is an enlarged view, of a portion VI of FIG. 5.
Figure 7:
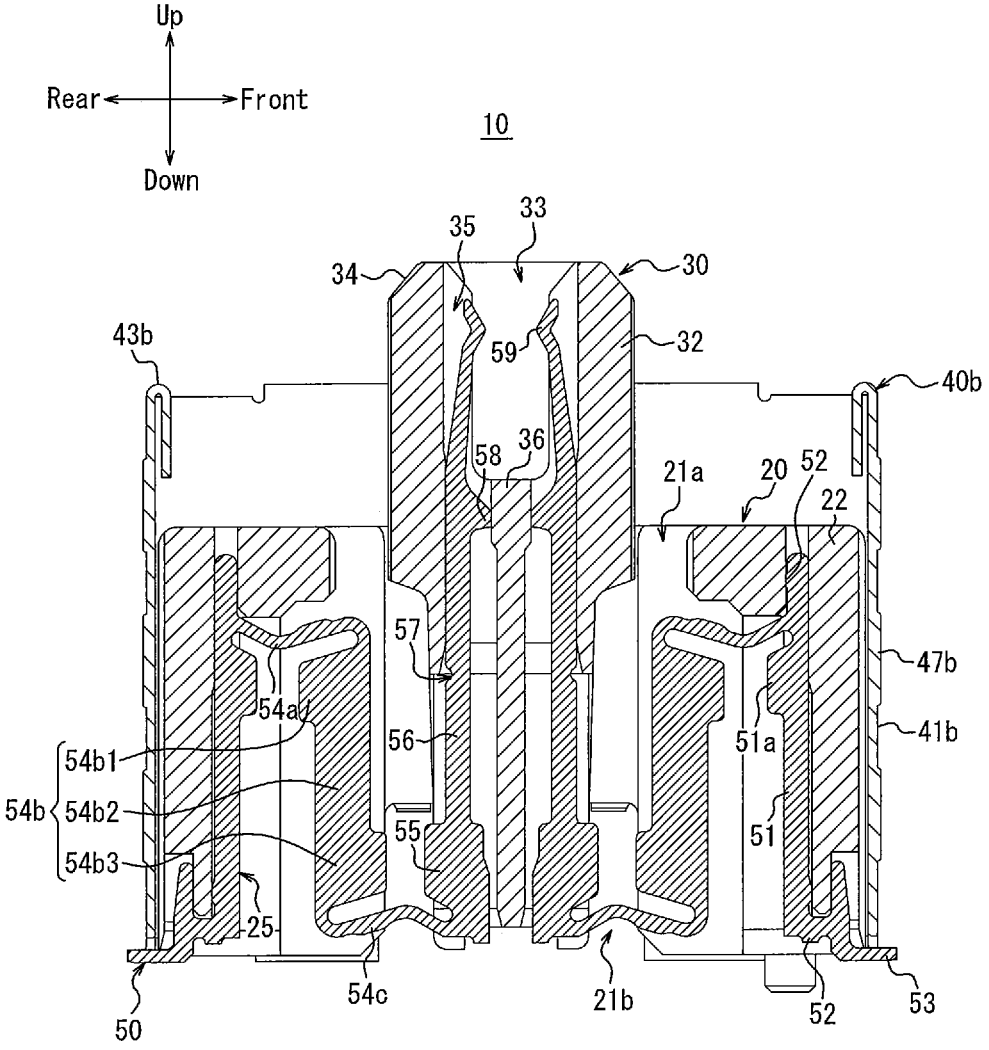
FIG. 7 is a cross-sectional view taken from arrow V-V of FIG. 3.
Figure 8:
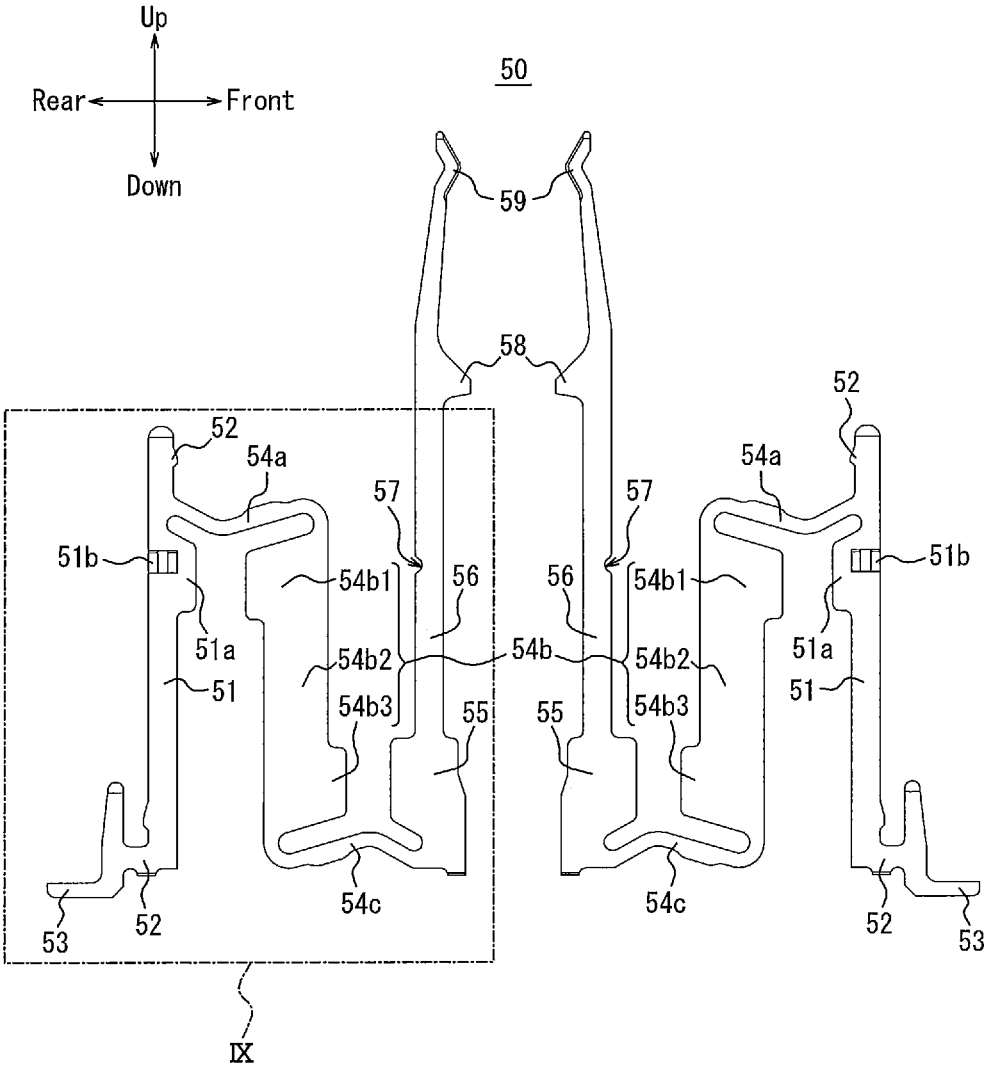
FIG. 8 is an elevation view of a pair of contacts.
Figure 9:
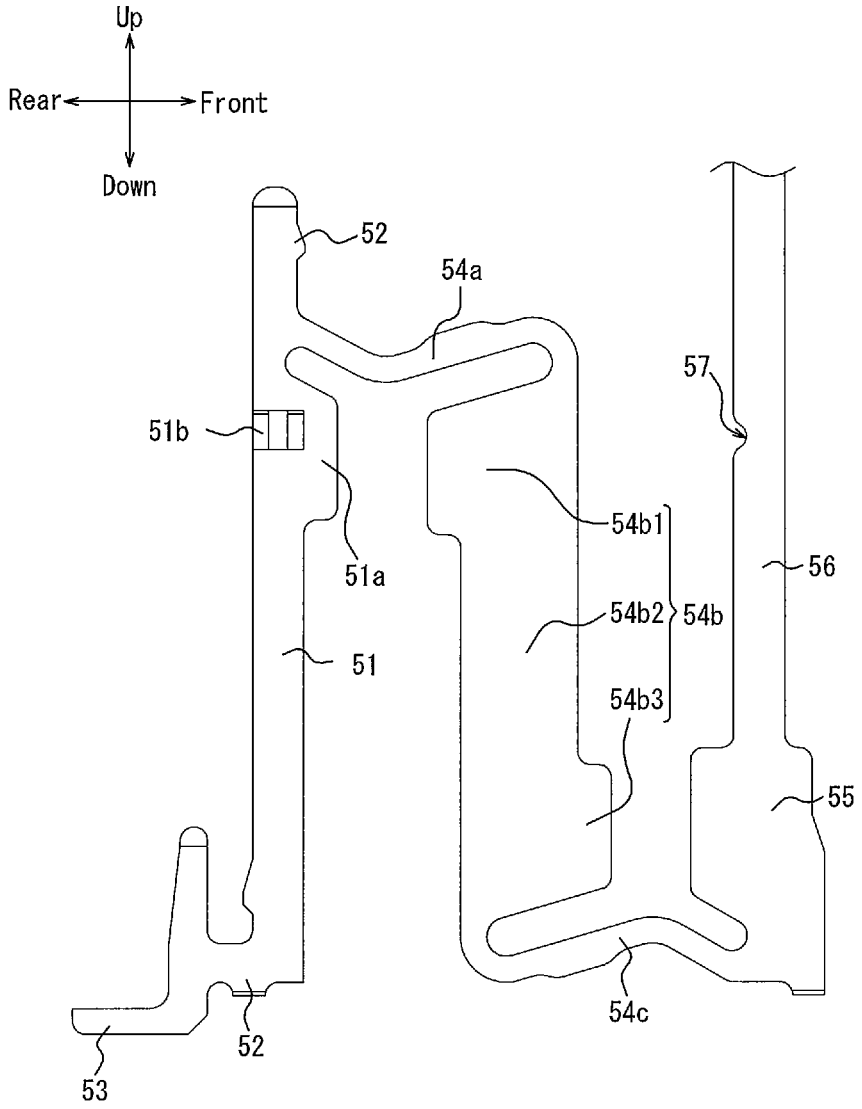
FIG. 9 is an enlarged view of a portion IX of FIG. 8.

FIG. 3 is an external top perspective view illustrating the connector 10 according to the present embodiment. FIG. 4 is an exploded top perspective view of the connector 10 of FIG. 3. FIG. 5 is a cross-sectional view taken from arrow V-V of FIG. 3. FIG. 6 is an enlarged view of a portion VI of FIG. 5. FIG. 7 is a cross-sectional view taken from arrow VI-VI of FIG. 3. FIG. 8 is an elevation view of a pair of contacts 50. FIG. 9 is an enlarged view of a portion IX of FIG. 8.

As illustrated in FIG. 4, the connector 10 includes, as main constituent elements, a first insulator 20, a second insulator 30, fitting brackets 40*a*, a shieling member 40*b*, and the contacts 50. The connector 10 is assembled in the following manner by way of example. The fitting brackets 40*a* are press-fitted into the first insulator 20 from below. The second insulator 30 is arranged within the first insulator 20 having the fitting brackets 40*a* press-fitted thereinto. The contacts 50 are press-fitted into the first insulator 20 and the second insulator 30 from below. The shielding member 40*b* is press-fitted into the first insulator 20 from above.

A configuration of the connector 10 in a state in which the contacts 50 are not elastically deformed will be described with reference mainly to FIG. 3 to FIG. 9.

As illustrated in FIG. 4 and FIG. 5, the first insulator 20 is a rectangular tubular member obtained by performing injection molding of a synthetic resin material having insulating and heat-resistant properties. The first insulator 20 is hollow and has an opening 21*a* and an opening 21*b* on its top surface and bottom surface, respectively. The first insulator 20 includes an outer peripheral wall 22 constituted of four side surfaces surrounding the space therein. The first insulator 20 includes fitting bracket attachment grooves 23 recessed along the up-down direction at left and right end portions of the outer peripheral wall 22 within the first insulator 20. The fitting brackets 40*a* are attached to the fitting bracket attachment grooves 23. The first insulator 20 includes engaging portions 24 that protrude outward at the left and right end portions of the outer peripheral wall 22. The shielding member 40*b* is attached to the engaging portions 24.

The first insulator 20 includes a plurality of contact attachment grooves 25 formed in the lower edge portions of the front and rear surfaces of the outer peripheral wall 22 across the bottom surface and the inner surface. The plurality of contact attachment grooves 25 are formed as recesses arranged side by side in the left-right direction. The contact attachment grooves 25 extend in the up-down direction on the inner surface of the first insulator 20. The plurality of contacts 50 are respectively attached to the plurality of contact attachment grooves 25.

The second insulator 30 is a member obtained by performing injection molding of a synthetic resin having insulating and heat-resistant properties. The second insulator 30 is formed in an approximate convex shape in an elevation view from the front direction. The second insulator 30 includes a bottom portion 31 that constitutes a lower portion, and a fitting projection 32 that protrudes upward from the bottom portion 31 to be fitted into the connection object 60. The bottom portion 31 is longer than the fitting projection 32 in the left-right direction. That is, the left and right end portions of the bottom portion 31 protrude outward from the left and right end portions of the fitting projection 32. The second insulator 30 also includes a fitting recess 33 formed in a recessed manner on the top surface of the fitting projection 32. The second insulator 30 further includes a guiding portion 34 that extends on an upper edge portion of the fitting projection 32 and surrounds the fitting recess 33. The guiding portion 34 is formed as an inclined surface that is inclined obliquely inward in the upward direction.

The second insulator 30 includes a plurality of contact attachment grooves 35 formed side by side in the left-right direction. The plurality of contact attachment grooves 35 extend in the up-down direction. The lower portions of the contact attachment grooves 35 are formed in the lower portions of the front and rear surfaces of the second insulator 30 formed in a recessed manner. The central portions of the contact attachment grooves 35 are formed within the second insulator 30. The upper portions of the contact attachment grooves are formed in the front and rear inner surfaces of the fitting recess 33 in a recessed manner. The plurality of contact attachment grooves 35 allow the respective plurality of contacts 50 to be fitted thereto.

The second insulator 30 includes a wall 36 that extends downward within the second insulator 30 from the bottom surface of the fitting recess 33 as illustrated in FIG. 5 and FIG. 6. The wall 36 is located between a pair of contacts 50 which is arranged in the front-rear direction and attached to the second insulator 30. The wall 36 opposes each of the pair of contacts 50. The wall 36 is formed to be widest in its top portion. The central portion and the lower portion of the wall 36 are formed to be narrower than the upper portion. The front and rear surfaces of the wall 36 constitute portions of the contact attachment grooves 35. The central portions of the contact attachment grooves 35 formed within the second insulator 30 are tapered with respect to the front-rear direction toward their tops, following the change in the widths of the central portion and the upper portion of the wall 36.

The fitting brackets 40*a* are obtained by shaping thin plates made of any metallic material into the shape as illustrated in FIG. 4 by using a progressive die (stamping). The fitting brackets 40*a* are press-fitted into the respective fitting bracket attachment grooves 23 and located on the left and right end portions of the first insulator 20. Each of the fitting brackets 40*a* is formed as an approximate H-shape in an elevation view in the left-right direction. The fitting brackets 40*a* include respective mounting portions 41*a* that extend outward in an approximate U-shape at the lower end portion in the front or rear surface of the fitting bracket 40*a*. The fitting brackets 40*a* include respective connection portions 42*a* that extend in the front-rear direction at the approximately central portion of the fitting bracket 40*a* with respect to the up-down direction. The fitting brackets 40*a* include respective retainer portions 43*a* that extend inward in the left-right direction from the lower edge portion of the approximately central portion of the connection portion 42*a*. The retainer portions 43*a* inhibit displacement of the second insulator 30 with respect to the first insulator 20. Each of the fitting brackets 40*a* further includes latches 44*a* that are formed in the upper end portions thereof on the front-rear sides and configured to latch to the first insulator 20.

The shielding member 40*b* is obtained by shaping any appropriate material having electrical conductivity into a shape as illustrated in FIG. 4. The shielding member 40*b* may be made of metal or may include a resin material and have electrical conductivity on its surface. The shielding member 40*b* is constituted of a pair of members having the same shape. The shielding member 40*b* constituted of a pair of members is press-fit into the engaging portion 24 and surrounds the first insulator 20 and the second insulator 30 in the front-rear and left-right directions.

The shielding member 40*b* includes first shielding portions 41*b* each of which has a width in the up-down direction and linearly extends in the left-right direction. The first shielding portions 41*b* cover substantially the entire outer surface of the first insulator 20 in the front-rear direction. The shielding member 40*b* includes second shielding portions 42*b* that extend inward in the front-rear direction while bending from the left and right side edges of the first shielding portions 41*b*. Each of the second shielding portions 42*b* has a width in the front-rear direction. The second shielding portions 42*b* partially cover the left and right side outer surfaces of the first insulator 20.

The shielding member 40*b* includes first bending portions 43*b* bent inward in an approximate inverted U-shape from the entire central portions of the upper edge portions of the first shielding portions 41*b*. The first bending portions 43*b* extend in the left-right direction at the upper edge portions of the first shielding portions 41*b*. The shielding member 40*b* includes second bending portions 44*b* bent outward in an approximate inverted U-shape from substantially the entire upper edge portions of the second shielding portions 42*b*. The second bending portions 44*b* extend in the front-rear direction at the upper edges of the second shielding portions 42*b*.

The shielding member 40*b* includes engaging portions 45*b* that linearly extend downward at the inner end portions of the second shielding portions 42*b*. When the engaging portions 45*b* engage with the engaging portions 24 of the first insulator 20, the shielding member 40*b* is fixed to the first insulator 20. The shielding member 40*b* includes mounting portions 46*b* that extend outward in an approximate L-shape from each of the left and right end portions of the bottom edges of the first shielding portions 41*b*. The shielding member 40*b* includes protruding portions 47*b* formed by the outer surfaces of the first shielding portions 41*b* protruding linearly along the left-right direction.

As illustrated in FIG. 4 to FIG. 9, each of the contacts 50 is obtained by shaping thin plate made of, for example, a copper alloy having spring elasticity such as phosphor bronze, beryllium copper, or titanium copper, or a Corson type copper alloy into the shape as illustrated in the figures by using the progressive die (stamping). The contacts 50 are formed only by punching. The contacts 50 are made of a metallic material having a small elastic modulus, so as to be largely deformed by elastic deformation. The surfaces of the contacts 50 are plated with gold or tin after forming a nickel plate base.

As illustrated in FIG. 4, the plurality of contacts 50 are arranged in the left-right direction. As illustrated in FIG. 5 to FIG. 7, the contacts 50 are fitted to the first insulator 20 and the second insulator 30. Pairs of contacts 50 arranged in the same positions on the left and right sides are symmetrically formed and arranged along a direction substantially orthogonal to the arrangement direction of the contacts 50. In particular, the pairs of contacts 50 are formed and arranged so as to be substantially linearly symmetric with respect to a vertical axis passing through the center between the pairs of contacts 50.

The contacts 50 include respective bases 51 that extend in the up-down direction and are supported by the first insulator 20. The contacts 50 include respective latches 52 that are formed at the top portion of the base 51 and configured to latch to the first insulator 20. The latches 52 are formed further on the fitting side than first wide portions 51*a*, which will be described later. The latches 52 are formed continuously with the lower end portions of the bases 51 and latch to the first insulator 20. The bases 51 and the latches 52 are accommodated in the contact attachment grooves 25 of the first insulator 20. The contacts 50 include respective mounting portions 53 that extend outward in an approximate L-shape from the lower end portions of the outer surfaces of the latches 52.

The contacts 50 include respective first wide portions 51*a* that constitute a portion of the base 51 and are located on the first insulator side. The first wide portions 51*a* are located along the inner surfaces of the outer peripheral wall 22 inside the first insulator 20. The first wide portions 51*a* do not directly latch to the first insulator 20 and are supported by the latches 52 which latch to the first insulator 20. The first wide portions 51*a* are formed continuously with first elastic portions 54*a* described later. The first wide portions 51*a* are formed adjacent to the first elastic portions 54*a* in the vicinity of the outer end portions of the first elastic portion 54*a*.

The first wide portions 51*a* protrude further toward the second insulator 30 in a direction substantially orthogonal to the arrangement direction of the contacts 50 than the other portions of the contacts 50 along the first insulator 20. In particular, the first wide portions 51*a* protrude further to the inner side as a step in the front-rear direction than the other portions of the bases 51. The first wide portions 51*a* are wider in the front-rear direction than the other portions of the bases 51. Similarly, the first wide portions 51*a* are wider than the first elastic portions 54*a*. As described above, the first wide portions 51*a* have cross-sections larger than the other portions of the bases 51 and the first elastic portions 54*a* as a whole. Thus, the first wide portions 51*a* have an electrical conductivity that is higher than those of the other portions of the bases 51 and the first elastic portions 54*a*. In particular, the first wide portions 51*a* have a characteristic impedance that is lower than those of the other portions of the bases 51 and the first elastic portions 54*a*.

As illustrated in FIG. 8 and FIG. 9, the contacts 50 include respective concave-convex portions 51*b* that are formed on the surface of the first wide portions 51*a*. On one of the left-side or right-side of the outer surface, the concave-convex portions 51*b* are formed such that concave portions formed in the center are surrounded by the convex portions on the front and rear sides. On the other hand, on the other side of the outer surface, the concave-convex portions 51*b* are formed so that the convex portions formed in the center are surrounded by the concave portions on the front and rear sides. The concave-convex portions 51*b* contact the surfaces of the contact attachment grooves 25 in a state where the contacts 50 are attached to the first insulator 20. Thus, twisting of the contacts 50, formed to be narrow in the left-right direction by punching, along the left-right direction is suppressed. This enables stable attachment of the contacts 50 having a narrow width in the left-right direction to the first insulator 20. Even when the second insulator 30 moves relative to the first insulator 20 in the state in which the connector 10 and the connection object 60 are fitted to each other, the twisting in the left-right direction applied to the contacts 50 is suppressed.

The contacts 50 include respective first elastic portions 54*a* that are elastically deformable and extend inward along the front-rear direction from the respective bases 51. The first elastic portions 54*a* extend obliquely downward from the bases 51 in the inward direction and then bend obliquely upward and linearly extend in that state. The first elastic portions 54*a* bend downward again at the inner end portion thereof and are connected to the upper end portions of respective intermediate portions 54*b*, which will be described later. The first elastic portions 54*a* are formed to be narrower than the bases 51 and the first wide portions 51*a*. Thus, the first elastic portions 54*a* can adjust portions to be elastically displaced.

The contacts 50 include the respective intermediate portions 54*b* formed continuously with the first elastic portions 54*a*. The intermediate portions 54*b* are formed to be wider than the first elastic portions 54*a* as a whole; that is, have a larger cross-sectional area and thus have higher electrical conductivity than the first elastic portions 54*a*. The intermediate portions 54*b* extend in the fitting direction in a state in which the contacts 50 are not elastically deformed.

The intermediate portions 54*b* include respective first adjustment portions 54*b*1, second adjustment portions 54*b*2, and third adjustment portions 54*b*3 that constitute upper portions, central portions, and lower portions of the intermediate portions 54*b*, respectively. The upper end portions of the first adjustment portions 54*b*1 are connected to the first elastic portions 54*a*. The first adjustment portions 54*b*1 have cross-sectional areas larger than those of the first elastic portions 54*a*. The first adjustment portions 54*b*1 protrude from the second adjustment portions 54*b*2 as a step along the front-rear direction. The second adjustment portions 54*b*2 have cross-sectional areas smaller than those of the first adjustment portions 54*b*1 and larger than those of the first elastic portions 54*a*. For example, the second adjustment portions 54*b*2 are formed to be narrower than the first adjustment portions 54*b*1 and wider than the first elastic portions 54*a*, with respect to the front-rear direction. The third adjustment portions 54*b*3 have cross-sectional areas larger than those of the second adjustment portions 54*b*2. The third adjustment portions 54B3 protrude from the second adjustment portions 54*b*2 as a step along the front-rear direction. In the intermediate portions 54*b*, thus, each of the first adjustment portions 54*b*1 and the third adjustment portions 54*b*3 have high electric conductivities, and the second adjustment portions 54*b*2 have electric conductivities lower than those of the first adjustment portions 54*b*1 and the third adjustment portions 54*b*3. The first adjustment portions 54*b*1 and the third adjustment portions 54*b*3 are symmetrically formed. In particular, the first adjustment portions 54*b*1 and the third adjustment portions 54*b*3 are formed to be substantially point-symmetrical with respect to the centers of the intermediate portions 54*b*.

The contacts 50 include respective second elastic portions 54*c* that are elastically deformable and extend from the bottom portions of the third adjustment portions 54*b*3 to the second insulator 30. The second elastic portions 54*c* bend obliquely upward from the bottom portions of the third adjustment portions 54*b*3 and then linearly extend in that state. Then, the second elastic portions Mc bend again obliquely downward and are connected to the outer end portions of second wide portions 55, which will be described later. The second elastic portions 54*c* are formed to be narrower than the intermediate portions 54*b*, in a manner similar to the first elastic portions 54*a*. Thus, the second elastic portions 54*c* can adjust portions to be elastically displaced.

The first elastic portion 54*a*, the intermediate portion 54*b*, and the second elastic portion 54*c* are integrally formed in an approximate crank shape. The first elastic portion 54*a*, the intermediate portion 54*b*, and the second elastic portion 54*c* are sequentially located from a fitting side along the fitting direction. The first elastic portions 54*a* and the second elastic portions 54*c* are symmetrically formed with respect to the intermediate portions 54*b*. In particular, the first elastic portions 54*a* and the second elastic portions 54*c* are formed to be substantially point-symmetrical with respect to the centers of the intermediate portions 54*b*.

The first elastic portions 54*a* and the second elastic portions 54*c* extend from the opposite end portions of the intermediate portion 54*b* in the fitting direction. In particular, the first elastic portions 54*a* extend from the upper end portions of the first adjustment portion 54*b*1 on the inner side. On the other hand, the second elastic portions 54*c* extend from the lower end portions of the third adjustment portions 54*b*3 on the outer side. Thus, contact points between the first elastic portions 54*a* and the intermediate portions 54*b* and contact points between the second elastic portions 54*c* and the intermediate portions 54*b* are in symmetrical positions with respect to the centers of the intermediate portions 54*b*. The first elastic portion 54*a* and the second elastic portion 54*c* are continuous with the intermediate portion 54*b* at the end portion opposite to the end portion continuous with the first wide portion 51*a* and at the end portion opposite to the end portion continuous with the second wide portion 55 described later, respectively. In particular, the first elastic portion 54*a* is continuous with the first wide portion 51*a* at the outer end portion and continuous with the intermediate portion 54*b* at the inner end portion. Similarly, the second elastic portion 54*c* is continuous with the second wide portion 55 at the inner end portion and continuous with the intermediate portion 54*b* at the outer end portion.

The contacts 50 include respective second wide portions 55 that are continuous with the second elastic portions 54*c*, as illustrated in FIG. 7 and FIG. 8. The second wide portions 55 are formed adjacent to the second elastic portions 54*c* in the vicinity of the inner end portions of the second elastic portions 54*c*. The second wide portions 55 are located on the second insulator side. The second wide portions 55 are located within the contact attachment grooves 35 of the second insulator 30. The second wide portions 55 do not directly latch to the second insulator 30 and are supported by the latches 58 which latch to the second insulator 30.

The second wide portions 55 protrude toward the first insulator 20 in the direction substantially orthogonal to the arrangement direction of the contacts 50 from other portions of the contacts 50 along the second insulator 30. In particular, the second wide portions 55 protrude outward as a step in the front-rear direction from third elastic portions 56, latches 58, and elastic contact portions 59, which will be described later. The second wide portions 55 are formed to be wider in the front-rear direction than the third elastic portions 56, the latches 58, and the elastic contact portions 59. Similarly, the second wide portions 55 are formed to be wider than the second elastic portions 54*c*. Thus, the second wide portions 55 have the respective cross-sectional areas larger than those of the second elastic portions 54*c*, the third elastic portions 56, the latches 58, and the elastic contact portions 59 as a whole. Accordingly, the second wide portions 55 have higher electrical conductivity than the second elastic portions 54*c*, the third elastic portions 56, the latches 58, and the elastic contact portions 59. In particular, the second wide portions 55 have lower characteristic impedance than the second elastic portions 54*c*, the third elastic portions 56, the latches 58, and the elastic contact portions 59.

The contacts 50 include the third elastic portions 56 that are elastically deformable, extend upward from the second wide portions 55, and arranged along the inner wall of the second insulator 30. The third elastic portions 56 extend in the fitting direction when not elastically deformed. The third elastic portions 56 in their entirety oppose the wall 36 of the second insulator 30 formed on the inner side. The contacts 50 include notches 57 formed on the surface of the third elastic portion 56 to constitute a bending point of elastic deformation of the third elastic portions 56. The notches 57 are formed as a cut off on the outer surface at a substantially central portion in the front-rear direction of the third elastic portion 56. The contacts 50 include the latches 58 that are formed at the upper portions of the third elastic portions 56 in a manner continuous therewith and latch to the second insulator 30. The latches 58 are formed to be wider than the third elastic portions 56. The contacts 50 include respective elastic contact portions 59 that are formed at the upper portions of the latches 58 in a manner continuous therewith and come into contact with the contacts 90 of the connection object 60 in the fitting state in which the connector 10 and the connection object 60 are fitted to each other. In the contacts 50, the elastic contact portions 59 are formed at, for example, distal ends that are continuous from the second adjustment portions 54*b*2 on an opposite side from the first adjustment portions 54*b*1.

As illustrated in FIG. 5 to FIG. 7, the second wide portions 55, the third elastic portions 56, the notches 57, and the latches 58 are accommodated in the contact attachment grooves 35 of the second insulator 30. The second wide portions 55, the third elastic portions 56, and the latches 58, in substantially their entirety, oppose the wall 36 of the second insulator 30 formed on the inner side. The second wide portions 55 connecting the second elastic portions 54*c* and the third elastic portions 56 together are arranged at positions facing the lower end portion of the wall 36.

The second wide portions 55 and the lower half portions of the third elastic portions 56 are accommodated in the lower portions of the contact attachment grooves 35 formed as recesses on the front and rear surfaces of the second insulator 30. The upper half portions of the third elastic portions 56 and the latches 58 are accommodated in the central portions of the contact attachment grooves 35 formed by the inside of the second insulator 30. The notches 57 are formed on the surfaces of the third elastic portions 56 in the vicinity of boundaries between the lower portions and the central portions of the contact attachment grooves 35.

The elastic contact portions 59 are substantially accommodated in the upper portions of the contact attachment grooves 35 configured as recesses formed on the inner surfaces of the fitting recess 33 of the second insulator 30. The distal ends of the elastic contact portions 59 are exposed to the fitting recess 33 from the contact attachment grooves 35.

Figure 10:
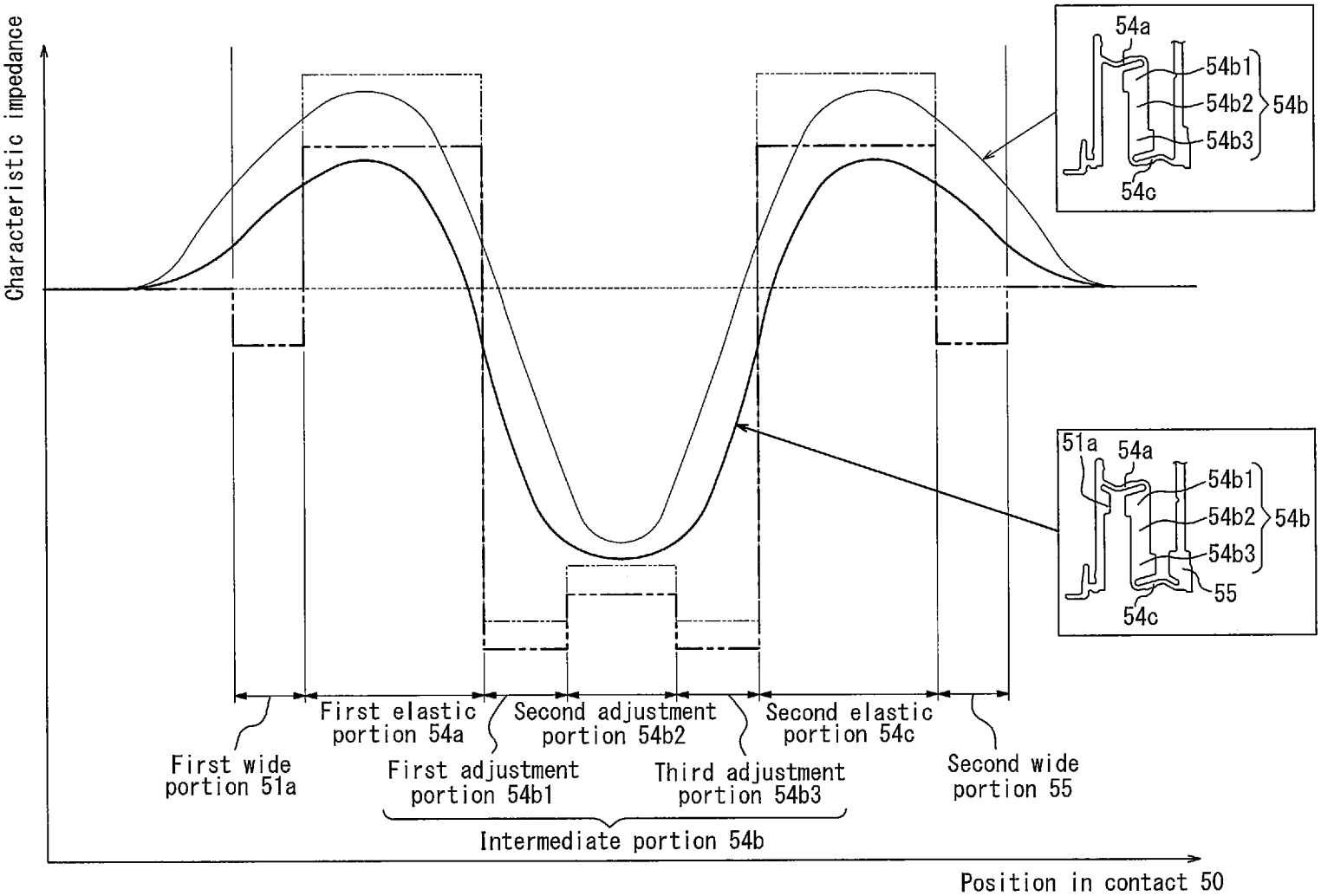
FIG. 10 is a schematic diagram illustrating a change in a characteristic impedance in each portion of the contact.

FIG. 10 is a schematic diagram illustrating a change in the characteristic impedance in portions of each of the contacts 50. Functions of the first wide portion 51*a* and the second wide portion 55 will be described with reference to FIG. 10. In FIG. 10, the vertical axis indicates the magnitude of the impedance. The horizontal axis indicates a position on a contact 50. The solid lines represent a measured value of the impedance. The two-dot chain lines represent a theoretical value of the characteristic impedance. Each of the measured value and the theoretical value is indicated by a thick line and a thin line. The thick line indicates a change in the characteristic impedance when the first wide portion 51*a* and the second wide portion 55 are formed in a manner similar to the contacts 50 according to the present embodiment. On the other hand, the thin line represents a change in the characteristic impedance in an assumed case in which the first wide portion 51*a* and the second wide portion 55 are not formed. The broken line represents an ideal value of the characteristic impedance. The change in the characteristic impedance when the first wide portion 51*a* and the second wide portion 55 are not formed will be described with reference to the thin line, for comparison with the function of the first wide portion 51*a* and the second wide portion 55 of the contacts 50 according to the present embodiment.

The overall characteristic impedance of the first elastic portion 54*a*, the intermediate portion 54*b*, and the second elastic portion 54*c* is adjusted by the intermediate portion 54*b*. Theoretically, the characteristic impedance in each of the portions changes discretely according to the widths, i.e., cross-sectional areas, of the portions but, in fact, it is considered that the characteristic impedance changes continuously. In each of the contacts 50, the first elastic portion 54*a* is formed to be narrow (has a narrow cross-sectional area) in order to obtain a large elastic deformation amount. Thus, the characteristic impedance adjusted to the ideal value increases in the first elastic portion 54*a*. Because the intermediate portion 54*b* formed continuously with the first elastic portion 54*a* is formed to be wide (has a large cross-sectional area), it is intended to cause the characteristic impedance increased in the first elastic portion 54*a* to fall below the ideal value in the intermediate portion 54*b*. Because the second elastic portion 54*c* formed continuously with the intermediate portion 54*b* is formed to be narrow (has a narrow cross-sectional area) in a manner similar to the first elastic portion 54*a*, the characteristic impedance which has fallen below the ideal value rises above the ideal value again in the second elastic portion 54*c*. In this manner, the intermediate portion 54*b* plays a role of canceling the increase in the characteristic impedance in the first elastic portion 54*a* and the second elastic portion 54*c* such that the characteristic impedance overall approaches the ideal value.

More specifically, the characteristic impedance is further reduced in the upper part of the intermediate portion 54*b* by the first adjustment portion 54*b*1 formed wider than the second adjustment portion 54*b*2. Thus, the characteristic impedance, having been increased to be higher than the ideal value in the first elastic portion 54*a*, is intentionally caused to fall below the ideal value at an early stage. In other words, an increase range of the characteristic impedance in the first elastic portion 54*a* is intentionally suppressed. In each of the contacts 50, the characteristic impedance is slightly increased in the central portion of the intermediate portion 54*b*, i.e., in the second adjustment portion 54*b*2. This inhibits an excessive reduction of the characteristic impedance in the second adjustment portion 54*b*2, i.e., an extreme deviation between the ideal value and the actual measured value. In each of the contacts 50, the characteristic impedance is further reduced in the lower portion of the intermediate portion 54*b* by the third adjustment portion 54*b*3 that is formed to be wide in a manner similar to the first adjustment portion 54*b*1. Thus, the characteristic impedance, lower than the ideal value in the intermediate portion 54*b*, is intentionally caused to exceed the ideal value at a late stage in the second elastic portion 54*c*. In other words, the increase width of the characteristic impedance in the second elastic portion 54*c* is intentionally suppressed. By subdividing the intermediate portion 54*b* into three components for adjusting the characteristic impedance, i.e., the electrical conductivity as described above, the intermediate portion 54*b* can cancel the increase in the characteristic impedance in the first elastic portion 54*a* and the second elastic portion 54*c* such that the characteristic impedance approaches the ideal value.

The change in the characteristic impedance in the case where the first wide portion 51*a* and the second wide portion 55 are formed in a manner similar to the contacts 50 according to the present embodiment will be described with reference to the thick line, as compared with the thin line. In each of the contacts 50 according to the present embodiment, the first wide portion 51*a* having a wide width (a large cross-sectional area) is formed adjacent to the first elastic portion 54*a* on the opposite side of the intermediate portion 54*b*. Thus, it is intended that the characteristic impedance having been increased is reduced in the first elastic portion 54*a* on the opposite side in a manner similar to the intermediate portion 54*b*. As a result, the range of increase of the characteristic impedance in the first elastic portion 54*a* is suppressed overall as compared to the thin line. In each of the contacts 50, similarly, the second wide portion 55 having a wide width (a large cross-sectional are) is formed adjacent to the second elastic portion 54*c* on the opposite side of the intermediate portion 54*b*. Thus, it is intended that the characteristic impedance having been increased is reduced in the second elastic portion 54*c* on the opposite side in a manner similar to the intermediate portion 54*b*. As a result, the range of increase of the characteristic impedance in the second elastic portion 54*c* is suppressed overall, as compared with the thin line. As described above, because the first wide portion 51*a* and the second wide portion 55 further adjust the characteristic impedance, the characteristic impedance having been increased in the first elastic portion 45*a* and the second elastic portion 54*c* is cancelled such that the characteristic impedance approaches the ideal value.

In the connector 10 configured as described above, the mounting portions 53 of the contacts 50 are soldered to the circuit pattern formed on the mounting surface of the circuit board CB1. The mounting portions 41*a* of the fitting brackets 40*a* and the mounting portions 46*b* of the shielding member 40*b* are soldered to the ground pattern or the like formed on the mounting surface. In this way, the connector 10 is mounted on the circuit board CB1. On the mounting surface of the circuit board CB1, electronic components other than the connector 10 such as, for example, a CPU, a controller, a memory, and the like are mounted.

Figure 11:
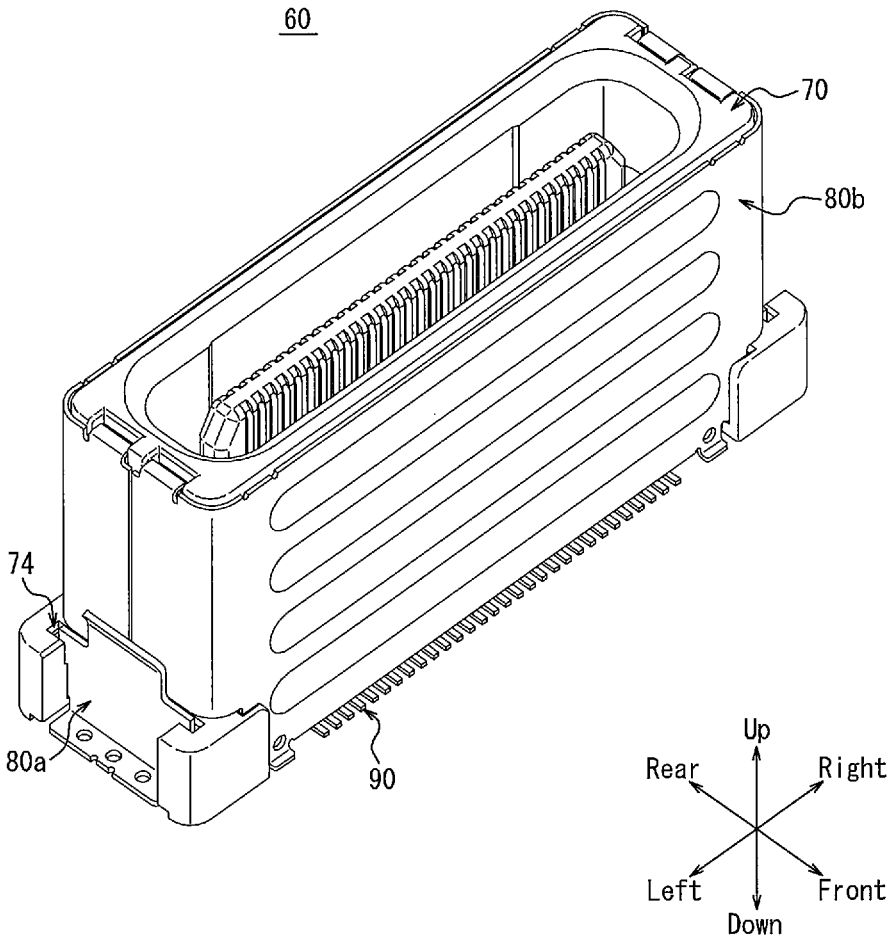
FIG. 11 is an external top perspective view of the connection object connected to the connector of FIG. 3.
Figure 12:
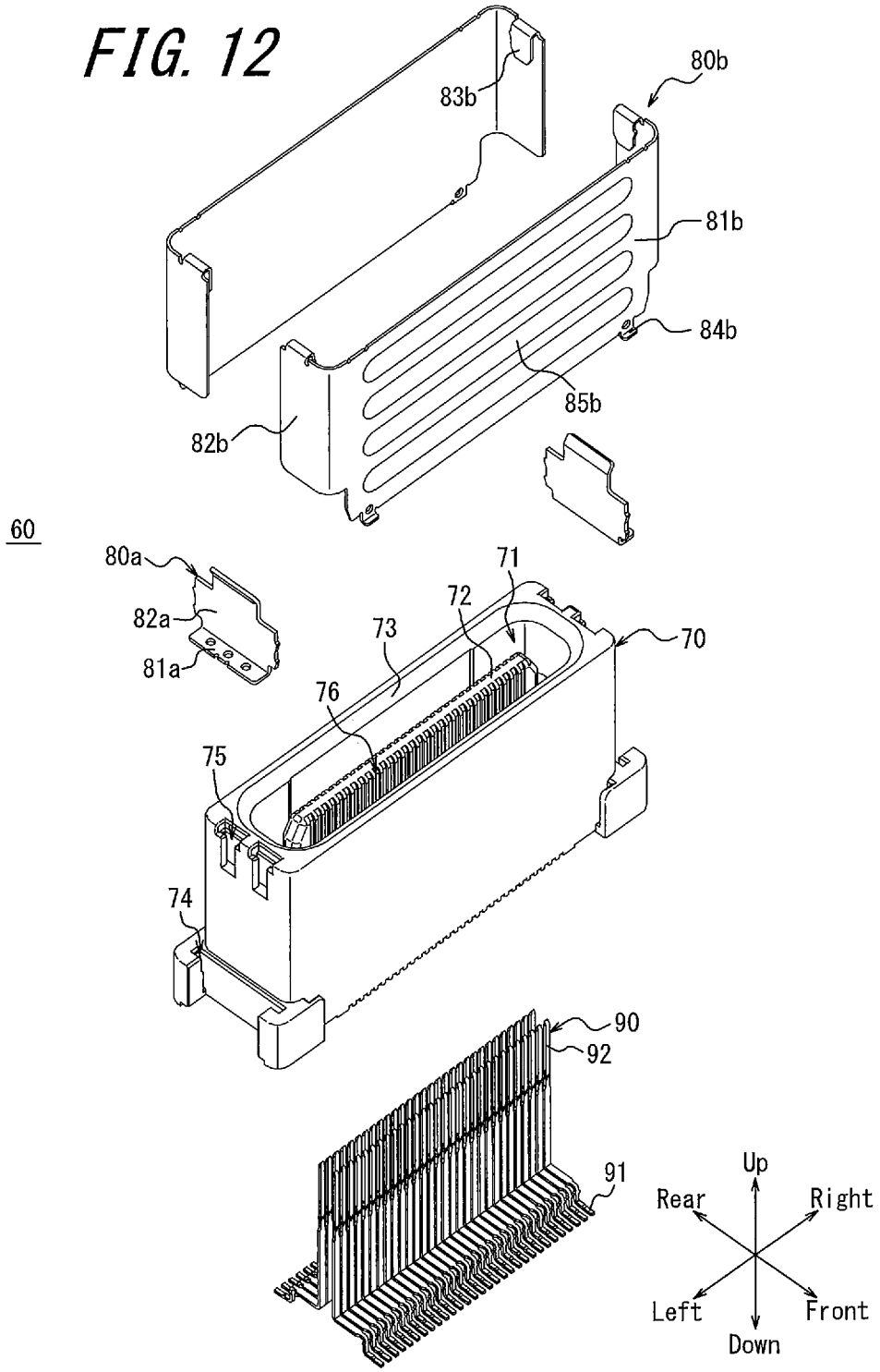
FIG. 12 is an exploded top perspective view of the connection object of FIG. 11.

FIG. 11 is an external top perspective view illustrating the connection object 60 to be connected to the connector 10 in FIG. 3. FIG. 12 is an exploded top perspective view of the connection object 60 of FIG. 11.

A configuration of the connection object 60 to be connected to the connector 10 according to the present embodiment will be mainly described with reference to FIG. 11 and FIG. 12.

As illustrated in FIG. 12, the connection object 60 includes an insulator 70, fitting brackets 80*a*, shielding member 80*b*, and the contacts 90, as main constituent elements. The connection object 60 is assembled by press-fitting the contacts 90 into the insulator 70 from therebelow and press-fitting the fitting brackets 80*a* and the shielding member 80*b* from above the insulator 70.

The insulator 70 is a rectangular columnar member obtained by performing injection molding of a synthetic resin material having insulating and heat-resistant properties. The insulator 70 includes a fitting recess 71 formed on the top surface of the insulator 70. The insulator 70 includes a fitting projection 72 formed within the fitting recess 71. The insulator 70 includes a guiding portion 73 surrounding the fitting recess 71 across the entire upper edge of the fitting recess 71. The guiding portion 73 is formed as an inclined surface inclined obliquely outwardly in the upward direction at the upper edge portion of the fitting recess 71. The insulator 70 includes engaging portions 74 that protrude outward at the left and right end portions of the bottom portion. The metal brackets 80*a* are attached to the engaging portions 74. The insulator 70 includes attachment grooves 75 that are recessed at the top end portions of the left and right end portions. The shielding member 80*b* is attached to the engaging portions 74.

The insulator 70 has a plurality of contact attachment grooves 76 formed on the front side of the bottom portion, on the inner side thereof, and the front surface of the fitting projection 72. The insulator 70 includes a plurality of contact attachment grooves 76 that are recessed across the rear side of the bottom portion, on the inner side thereof, and the rear surface of the fitting projection 72. The plurality of contact attachment grooves 76 are formed in a recessed manner and arranged side by side in the left-right direction. The contact attachment grooves 76 extend in the up-down direction on each of the front and rear surfaces of the fitting projection 72. The plurality of contacts 90 are attached to the respective contact attachment grooves 76.

Each of the fitting brackets 80*a* is obtained by forming a thin plate made of any metallic material into a shape as illustrated in the figure using a progressive die (stamping). The fitting brackets 80*a* are press-fitted into the engaging portions 74 and arranged in the left and right end portions of the insulator 70 as illustrated in FIG. 11. Each of the fitting brackets 80*a*, in the lower portion thereof, includes a mounting portion 81*a* that is formed in a substantially L-shape and extends outward. Each of the fitting brackets 80*a* includes a latch 82*a* that is formed continuously with the upper portion of the mounting portion 81*a* and latches to the insulator 70.

The shielding member 80*b* is formed into the shape illustrated in FIG. 12 by using any metal material having electrical conductivity. The shielding member 80*b* may be made of metal, or may contain a resin material and have electrical conductivity on the surface. The shielding member 80*b* is constituted of a pair of members having the same shape. The shielding member 80*b* constituted of a pair of members is press-fit into the attachment grooves 75 and surrounds the insulator 70 in the front-rear and left-right directions.

The shielding member 80*b* includes a first shielding portion 81*b* which has a width in the up-down direction and linearly extends in the left-right direction. The first shielding portion 81*b* covers substantially the entire outer surface in the front-rear direction of the insulator 70. The shielding member 80*b* includes second shielding portions 82*b* that bend from the left and right edges of the first shielding portions 81*b* and extend inward in the front-rear direction. The second shield portions 82*b* have widths in the front-rear direction. The second shielding portions 82*b* partially cover the outer side of left and right side surfaces of the insulator 70.

The shielding member 80*b* includes latches 83*b* that extend inward in a substantially inverted U-shape from the upper edge of the second shielding portions 82*b*. By the latches 83*b* latching to the attachment grooves 75 of the insulator 70, the shielding member 80*b* is fixed to the insulator 70. The shielding member 80*b* includes mounting portions 84*b* that extend outward in a substantially L-shape from the left and right ends of the lower edge portions of the first shielding portions 81*b*. The shielding member 80*b* includes protruding portions 85*b* formed by the outer surface of the first shielding portion 81*b* protruding linearly along the left-right direction.

The contacts 90 are obtained by shaping a thin plate made of, for example, a copper alloy having spring elasticity such as phosphor bronze, beryllium copper, or titanium copper, or a Corson type copper alloy into the shape as illustrated in the figure using a progressive die (stamping). The surfaces of the contacts 90 are plated with gold or tin after forming a nickel plate base.

The plurality of contacts 90 are arranged along the left-right direction. Each of the contacts 90 includes a mounting portion 91 that is formed in an approximate L-shape and extends outward. Each of the contacts 90 includes a contact portion 92 that is formed at the upper end portion thereof and comes into contact with the elastic contact portion 59 of the contact 50 of the connector 10 when the connector 10 and the connection object 60 are to be fitted together.

In the connection object 60 having the above structure, the mounting portion 91 of each of the contacts 90 is soldered to the circuit pattern formed on the mounting surface of the circuit board CB2. The mounting portion 81*a* of each of the fitting brackets 80 and the mounting portions 84*b* of the shielding member 80*b* are soldered to the ground pattern or the like formed on the mounting surface. In this way, the connection object 60 is mounted on the circuit board CB2. On the mounting surface of the circuit board CB2, electronic components other than the connection object 60 including, for example, a camera module, a sensor, and the like are mounted.

Figure 13:
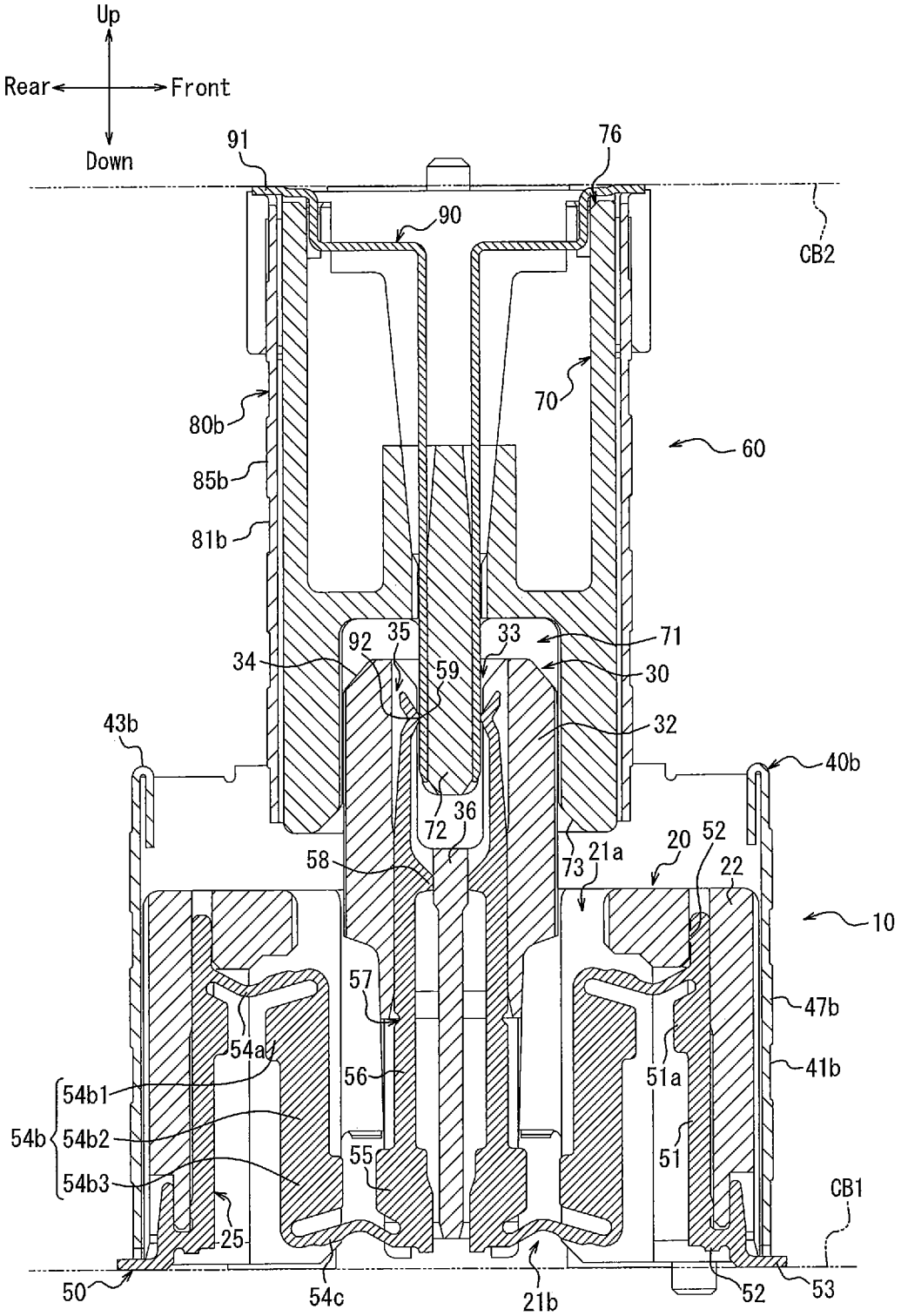
FIG. 13 is a cross-sectional view taken from arrow XIII-XIII of FIG. 1.

FIG. 13 is a cross-sectional view taken from arrow XIII-XIII of FIG. 1.

Operation of the connector 10 having the floating structure when the connection object 60 is fitted to the connector 10 will be described with reference mainly to FIG. 13.

The contacts 50 of the connector 10 support the second insulator 30 in a state in which the second insulator 30 is spaced apart from the first insulator 20 and floating within the second insulator 30. At this time, the lower portion of the second insulator 30 is surrounded by the outer peripheral wall 22 of the first insulator 20. The upper portion of the second insulator 30 including the fitting recess 33 protrudes upward from the opening 21*a* of the first insulator 20.

When the mounting portions 53 of the contacts 50 are soldered to the circuit board CB1, the first insulator 20 is fixed to the circuit board CB1. The second insulator 30 is movable relative to the fixed first insulator 20 by virtue of elastic deformation of the first elastic portion 54*a*, the second elastic portion 54*c*, and the third elastic portion 56 of each of the contacts 50.

At this time, the peripheral edge portion of the opening 21*a* of the first insulator 20 regulates excessive movement of the second insulator 30 in the front-rear and left-right directions with respect to the first insulator 20. When the second insulator 30 moves in the front-rear and left-right directions by a large amount and exceeds the design value due to elastic deformation of the contacts 50, the fitting projection 32 of the second insulator 30 comes into contact with the peripheral edge portion of the opening 21*a*. This inhibits the movement of the second insulator 30 further outward in the front-rear and left-right directions.

As illustrated in FIG. 2, in a state in which the connection object 60 is flipped over relative to the connector 10 having such a floating structure, the connector 10 and the connection object 60 are brought to oppose each other in such a manner that the front-rear positions and the left-right positions of the connector 10 and the connection object 60 substantially meet one another. Then, the connection object 60 is moved downward. At this time, even when the connector 10 and the connection object 60 are displaced from each other in the front-rear direction and the right-left direction, the guiding portion 34 of the connector 10 and the guiding portion 73 of the connection object 60 come into contact with each other. Thus, the second insulator 30 moves relative to the first insulator 20 due to the floating structure of the connector 10. In particular, the fitting projection 32 of the connector 10 is guided into the fitting recess 71 of the connection object 60.

When the connection object 60 is further moved downward, the fitting projection 32 of the connector 10 and the fitting recess 71 of the connection object 60 are fitted together. At this time, the fitting recess 33 of the connector 10 and the fitting projection 72 of the connection object 60 are fitted together. The contacts 50 of the connector 10 and the contacts 90 of the connection object 60 come into contact with one another in a state in which the second insulator 30 of the connector 10 and the insulator 70 of the connection object 60 are fitted together. In particular, the elastic contact portions 59 of the contacts 50 and the contact portions 92 of the contacts 90 come into contact with one another. At this time, the distal ends of the elastic contact portions 59 of the contacts 50 elastically deform towards the outside slightly and are elastically displaced towards the inside of the contact attachment grooves 35.

In this way, the connector 10 and the connection object 60 are fully connected to each other. At this time, the circuit board CB1 and the circuit board CB2 are electrically connected to each other via the contacts 50 and the contacts 90.

In this state, the pair of elastic contact portions 59 of the contacts 50 clamps the pair of contacts 90 of the connection object 60 from both front and rear sides by applying an inward elastic force along the front-rear direction. By virtue of the reaction of the pressing force to the contact 90 applied by the connection object 60 thus generated, the second insulator 30 receives a force acting in a removal direction, i.e., the upward direction, via the contacts 50 when the connection object 60 is removed from the connector 10. Accordingly, when the second insulator 30 is moved upward, the retainer portions 43*a* of the fitting brackets 40*a* press-fitted into the first insulator 20 illustrated in FIG. 4 inhibit upward displacement of the second insulator 30. The retainer portions 43*a* of the fitting brackets 40*a* press-fitted into the first insulator 20 are positioned directly above the left and right end portions of the bottom portion 31 of the second insulator 30 inside the first insulator 20. Thus, when the second insulator 30 is moved upward, the left and right end portions of the bottom portion 31 protruding outward come into contact with the retainer portions 43*a*. Thus, the second insulator 30 does not move further outward.

Figure 14:
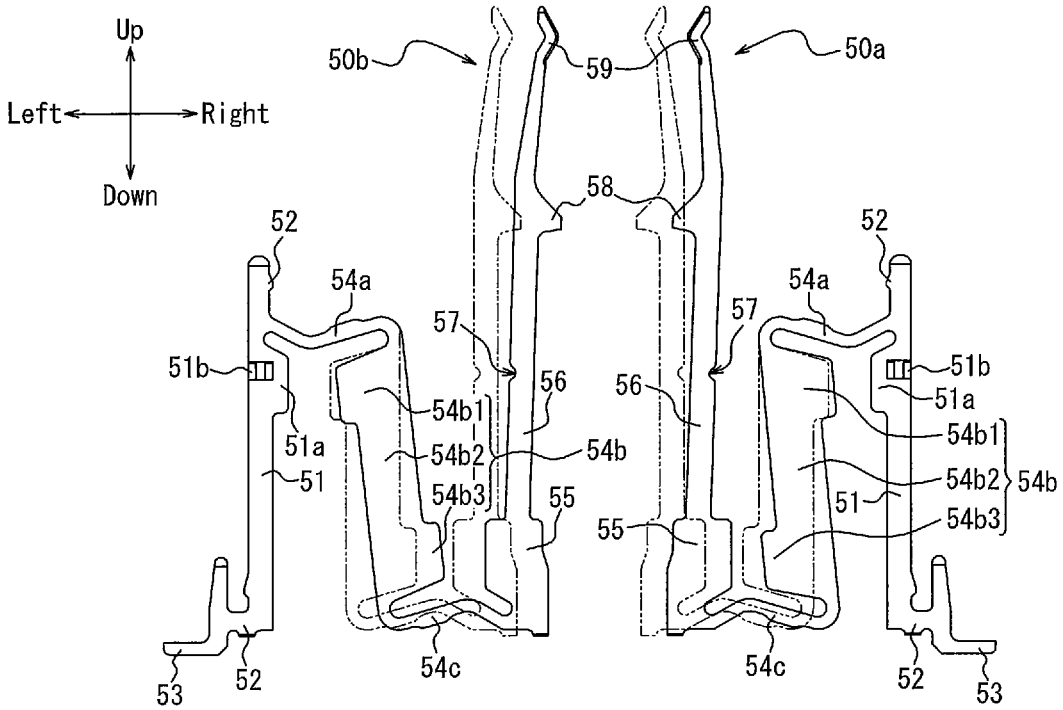
FIG. 14 is a schematic diagram illustrating a first example of elastic deformation of a pair of contacts.
Figure 15:
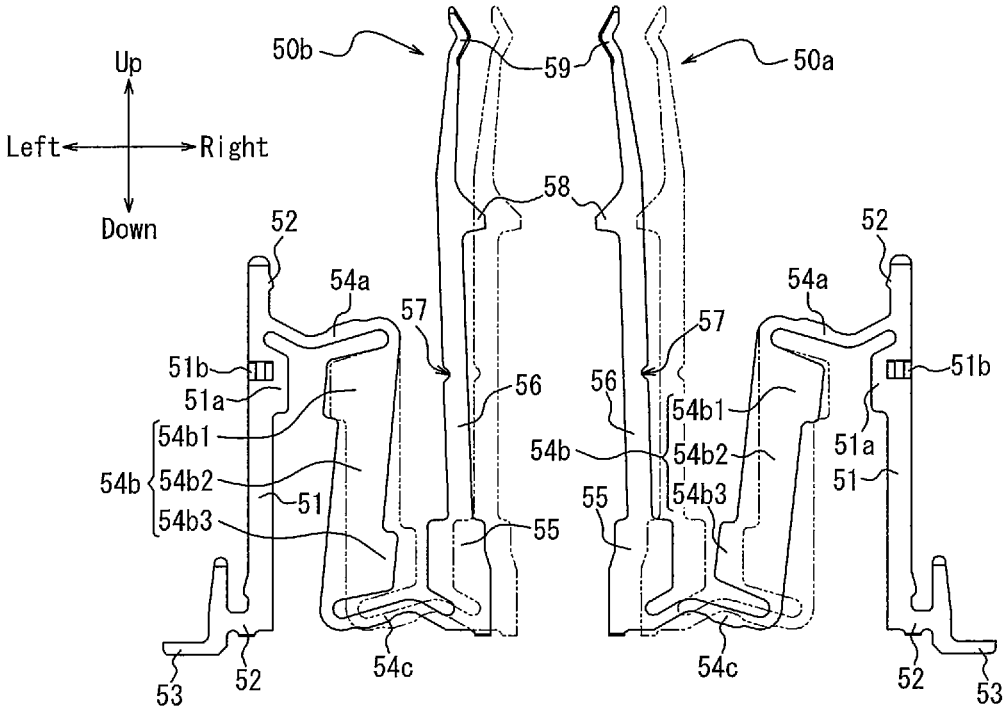
FIG. 15 is a schematic diagram illustrating a second example of elastic deformation of the pair of contacts.

FIG. 14 is a schematic diagram illustrating a first example of elastic deformation of a pair of contacts 50. FIG. 15 is a schematic diagram illustrating a second example of elastic deformation of the pair of contacts 50.

An operation performed by each constituent element when the pair of contacts 50 is elastically deformed will be described in detail with reference to FIG. 14 and FIG. 15. For the sake of simplicity of explanation, the contact 50 disposed on the right side in each of the drawings is referred to as a contact 50*a*, and the contact 50 disposed on the left side in each of the drawings will be described as a contact 50*b*. The two-dot chain lines in FIG. 14 and FIG. 15 indicate a state where the contacts 50*a* and 50*b* are not elastically deformed.

In FIG. 14, it is assumed that the second insulator 30 is moved to the right by some external factor, by way of example.

When the second insulator 30 is moved to the right, the latch 58 of the contact 50*a* is pushed to the right by the wall 36 of the second insulator 30. At this time, the third elastic portion 56 of the contact 50*a* is bent inward from the vicinity of the notch 57. The third elastic portion 56 of the contact 50*a* is elastically deformed more inward in the lower portion from the vicinity of the notch 57 than the upper portion. The relative position of the latch 58 of the contact 50*a* in contact with the wall 36 of the second insulator 30 is hardly changed. On the other hand, a relative position of the second wide portion 55 of the contact 50*a* changes inward.

When the third elastic portion 56 of the contact 50*a* is moved to the right, the second elastic portion 54*c* is elastically deformed, and a connection point between the second elastic portion 54*c* and the intermediate portion 54*b* is also moved to the right. On the other hand, a connection point between the first elastic portion 54*a* and the intermediate portion 54*b* is slightly moved in left-right direction. Thus, the first elastic portion 54*a* is elastically deformed in such a manner that a bent portion at the inner end portion is bent outward, and the intermediate portion 54*b* is inclined obliquely rightward from the upper portion to the lower portion.

When the second insulator 30 is moved to the right, the latch 58 of the contact 50*b* is pushed to the right by the inner wall of the second insulator 30. At this time, the third elastic portion 56 of the contact 50*b* is bent outward from the vicinity of the notch 57. The third elastic portion 56 of the contact 50*b* is elastically deformed more outward in the lower portion from the vicinity of the notch 57 than the upper portion. A relative position of the latch 58 of the contact 50*b* in contact with the inner wall of the contact attachment groove 35 with respect to the second insulator 30 is hardly changed. On the other hand, a relative position of the second wide portion 55 of the contact 50*b* is moved outward.

When the third elastic portion 56 of the contact 50*b* is moved to the right, the second elastic portion 54*c* is elastically deformed, and the connection point between the second elastic portion 54*c* and the intermediate portion 54*b* is also moved to the right. On the other hand, the connection point between the first elastic portion 54*a* and the intermediate portion 54*b* is slightly moved in the left-right direction. Thus, the first elastic portion 54*a* is elastically deformed such that the bent portion at the inner end portion is bent inward, and the intermediate portion 54*b* is inclined obliquely rightward from the upper portion to the lower portion.

In FIG. 15, it is assumed that the second insulator 30 is moved to the left by some external factor, by way of example.

When the second insulator 30 is moved to the left, the latch 58 of the contact 50*a* is pushed to the left by the inner wall of the second insulator 30. At this time, the third elastic portion 56 of the contact 50*a* is bent outward from the vicinity of the notch 57. The third elastic portion 56 of the contact 50*a* is elastically deformed more outward in the lower portion from the vicinity of the notch 57 than the upper portion. A relative position of the latch 58 of the contact 50*a* in contact with the inner wall of the contact attachment groove 35 with respect to the second insulator 30 is hardly changed. On the other hand, a relative position of the second wide portion 55 of the contact 50*a* is changed outward.

When the third elastic portion 56 of the contact 50*a* is moved to the left, the second elastic portion 54*c* is elastically deformed, and the connection point between the second elastic portion 54*c* and the intermediate portion 54*b* is also moved to the left. On the other hand, the connection point between the first elastic portion Ma and the intermediate portion 54*b* is slightly moved in the left-right direction. Thus, the first elastic portion 54*a* is elastically deformed such that the bent portion at the inner end portion is bent inward, and the intermediate portion 54*b* is inclined obliquely leftward from the upper portion to the lower portion.

When the second insulator 30 is moved to the left, the latch 58 of the contact 50*b* is pushed to the left by the wall 36 of the second insulator 30. At this time, the third elastic portion 56 of the contact 50*b* is bent inward from the vicinity of the notch 57. The third elastic portion 56 of the contact 50*b* is elastically deformed more inward in the lower portion from the vicinity of the notch 57 than the upper portion. A relative position of the latch 58 of the contact 50*b* in contact with the wall 36 of the second insulator 30 with respect to the second insulator 30 is hardly changed. On the other hand, a relative position of the second wide portion 55 of the contact 50*b* is changed inward.

When the third elastic portion 56 of the contact 50*b* is moved to the left, the second elastic portion 54*c* is elastically deformed, and the connection point between the second elastic portion 54*c* and the intermediate portion 54*b* is also moved to the left. On the other hand, the connection point between the first elastic portion 54*a* and the intermediate portion 54*b* is slightly moved in the left-right direction. Thus, the first elastic portion 54*a* is elastically deformed such that the bent portion at the inner end portion is bent outward, and the intermediate portion 54*b* is inclined obliquely leftward from the upper portion to the lower portion.

The connector 10 according to the present embodiment configured as described above has good transmission characteristics for signal transmission. In the connector 10, because each of the contacts 50 includes the first wide portion 51*a* and the second wide portion 55, the characteristic impedance is adjusted according to the width, i.e., the cross-sectional area of each transmission path. For example, the first wide portion 51*a* and the second wide portion 55 are formed to be wide by protruding in a direction substantially orthogonal to the arrangement direction of the contacts 50. Thus, the characteristic impedance of corresponding positions of the contacts 50 approaches the ideal value. The connector 10 can contribute to characteristic impedance matching. Therefore, according to the connector 10, desired transmission characteristics can be obtained for a large capacity and high speed transmission, and transmission characteristics can further improved as compared to conventional electrical connectors that do not include the first wide portion 51*a* and the second wide portion 55.

Because each of the wide portions protrudes in a direction substantially orthogonal to the arrangement direction of the contacts 50, the pitch between the adjacent contacts 50 is not affected in the arrangement direction of the contacts 50. In particular, when each of the wide portions protrudes in the arrangement direction of the contacts 50, the pitch between the adjacent contacts 50 increases. However, because each of the wide portions protrudes in the direction substantially orthogonal to the arrangement direction of the contacts 50, enlargement of the connector 10 in the arrangement direction of the contacts 50 can be avoided. In the connector 10, desired transmission characteristics can be obtained in this state. Thus, the connector 10 can be miniaturized along the arrangement direction of the contacts 50. In addition, because each of the wide portions protrudes toward the other insulator, each of the wide portions fits within the area in which the intermediate portion 54*b* is elastically displaced. This inhibits an unnecessary increase in the front-rear direction width of the contacts 50. Accordingly, the connector 10 can be miniaturized also along the direction substantially orthogonal to the arrangement direction of the contacts 50.

Because the contacts 50 are designed so that each of the wide portions protrudes in the direction substantially orthogonal to the arrangement direction of the contacts 50, the entire shape of the contacts 50 can be shaped simply by punching. This improves the productivity of the contacts 50. Even when the contacts 50 are designed to have a complicated shape, the contacts 50 can be easily manufactured. Thus, the contact 50 can be manufactured in a state in which the optimum shape according to the desired transmission characteristics is accurately maintained. In this way, the productivity of the contacts 50 is improved and, as a result, the productivity of the connector 10 is improved.

Because the first wide portion 51*a* and the second wide portion 55 are formed continuously with the first elastic portion 54*a* and the second elastic portion 54*c*, respectively, influence by each wide portion on each elastic portion formed to be narrow is more emphasized. This reduces the characteristic impedance of each of the elastic portions more effectively. Thus, an increase of characteristic impedance in each of the elastic portions is effectively cancelled as described with reference to FIG. 10.

Because the contacts 50 include the respective first adjustment portions 54*b*1, second adjustment portions 54*b*2, and third adjustment portions 54*b*3, the characteristic impedance in the corresponding portions of the contacts 50 can be adjusted to approach the ideal value of the characteristic impedance. In the connector 10, thus, desired transmission characteristics can be more easily obtained even in a large capacity and high speed transmission. The transmission characteristics are further improved as compared with that of the conventional electrical connectors that do not have the adjustment portions.

As will be described below, the connector 10 can realize an excellent floating structure in addition to excellent transmission characteristics for signal transmission as described above.

In the connector 10, because the contacts 50 includes the respective second elastic portions 54*c*, the moving amount of the second insulator 30 relative to the first insulator 20 can be further increased. In particular, in addition to elastic deformation of the first elastic portion 54*a*, elastic deformation of the second elastic portion 54*c* occurs. This increases the moving amount of the second insulator 30 relative to the first insulator 20.

In the connector 10, because the contacts 50 include the respective third elastic portions 56, the moving amount of the second insulator 30 relative to the first insulator 20 can be further increased. In particular, in addition to elastic deformation of the first elastic portion 54*a* and the second elastic portion 54*c*, elastic deformation of the third elastic portion 54*c* occurs. This increases the moving amount of the second insulator 30 relative to the first insulator 20. Conversely, because the connector 10 can allocate a part of the elastic deformation amounts of the contacts 50 necessary to obtain a predetermined movement amount to the third elastic portion 56 and thus reduce the elastic deformation amounts of the first elastic portion 54*a* and the second elastic portion 54*c*. As a result, the overall lengths of the first elastic portion 54*a*, the intermediate portion 54*b*, and the second elastic portion 54*c* are reduced, and the front-rear direction width of the connector 10 is reduced. This enables the connector 10 to contribute to the miniaturization thereof while securing the necessary moving amount of the second insulator 30.

Because the total length of the first elastic portion 54*a*, the intermediate portion 54*b*, and the second elastic portion 54*c* is reduced, the transmission characteristics of the connector 10 is further improved. Because of the reduction in the signal transmission path, the connector 10 can transmit high frequency signals with less transmission loss.

Because the connector 10 includes the wall 36 at a position where the second insulator 30 opposes the second wide portions 55, the pair of contacts 50 arranged symmetrically in the front-rear direction in FIG. 7 can be prevented from coming into contact with each other. As described above, the second wide portions 55 connecting the second elastic portions 54*c* and the third elastic portions 56 together are moved, for example, in the front-rear direction of FIG. 7 in accordance with elastic deformation of the second elastic portions 54*c* and the third elastic portions 56. At this time, in a case where the second insulator 30 does not include the wall 36, the second wide portions 55 of the pair of contacts 50 arranged in the front-rear direction potentially come into contact with each other, depending on their respective elastic deformation states. By formation of the wall 36, the connector 10 can prevent the second wide portions 55 from coming into contact with each other, and thus reduce electrically-induced defects such as short circuiting and mechanically-induced defects such as breakage. In other words, by virtue of the wall 36, the connector 10 can regulate excessive elastic deformation of the third elastic portions 56. Even in situations where the second wide portions 55 are moved in accordance with elastic deformation of the second elastic portions 54*c* and the third elastic portions 56, the connector 10 can secure its reliability as a product.

In the connector 10, the first adjustment portions 54*b*1 protrude outward from the second adjustment portions 54*b*2 as a step in the front-rear direction, and the third adjustment portions 54*b*3 protrude inward from the second adjustment portions 54*b*2 in the front-rear direction. This configuration prevents the first adjustment portions 54*b*1 and the third adjustment portions 54*b*3 from coming into contact with other portions of the contacts 50 and the second insulator 30 when the contacts 50 are elastically deformed, as illustrated in FIG. 14 and FIG. 15. Thus, the protruding portions of the first adjustment portion 54*b*1 and the third adjustment portion 54*b*3 of the connector 10 do not interfere with elastic deformation of the contacts 50, and the connector 10 can realize smooth movement of the second insulator 30 and contribute to an excellent floating structure.

In the connector 10, because the first elastic portions 54*a* and the second elastic portions 54*c* extend from both fitting-direction ends of the intermediate portion 54*b*, necessary moving amounts of the intermediate portions 54*b* can be secured. Thus, the connector 10 can secure the necessary moving amount of the second insulator 30. In the connector 10, the integral formation of the first elastic portions 54*a*, the intermediate portions 54*b*, and the second elastic portions 54*c* in an approximate crank shape can contribute to a reduction in the front-rear length in FIG. 7 while exerting the aforementioned effect. For example, the first elastic portions 54*a* extend from the inner end portions of the upper edge portions of the intermediate portions 54*b*, and the second elastic portions 54*c* extend from the outer end portions of the lower edge portions of the intermediate portions 54*b*. Thus, the front-rear length of the connector 10 in its entirety is reduced. Also, this configuration enables extension of the elastically deforming portions of the first elastic portions 54*a* and the second elastic portions 54*c* within the limited areas in the first insulator 20, and thus can realize an excellent floating structure.

Because the first elastic portions 54*a*, the intermediate portions 54*b*, and the second elastic portions 54*c* are sequentially arranged from the fitting side along the fitting direction, the second wide portions 55 connected to the second elastic portions 54*c* are located in the lowest position. This enables extension of the third elastic portion 56 and larger elastic deformation. Consequently, the moving amount of the second insulator 30 relative to the first insulator 20 is increased.

In the connector 10, because the contacts 50 further include the respective notches 57, the force applied to the latches 58 in contact with the inner wall of the second insulator 30 when the second insulator 30 is moved can be reduced. Similarly, the connector 10 can reduce the force applied to the elastic contact portions 59 located in the upper portions of the contact attachment grooves 35. The connector 10 can bend the third elastic portions 56 below the vicinity of the notches 57. In particular, in the third elastic portions 56 of in the connector 10, the elastic deformation amounts in the lower half portions are larger than those of the upper half portions between the lower end portions of the latches 58 and the vicinities of the notches 57. Thus, in a state in which the locking of the latches 58 to the second insulator 30 and the contact of the elastic contact portions 59 with the contact portions 92 are stable, the third elastic portions 56 can contribute to the movement of the second insulator 30 relative to the first insulator 20.

Because the contacts 50 are made of a metallic material having a small elastic modulus, the necessary moving amount of the second insulator 30 can be secured in response to a small force applied to the second insulator 30. The second insulator 30 can smoothly move with respect to the first insulator 20. Thus, the connector 10 can easily accommodate a positional deviation when being fitted to the connection object 60. In the connector 10, each of the elastic portions of the contacts 50 absorbs vibrations caused by some external factor. This inhibits application of a large force to the mounting portion 53 and damage to a connection portion between the connector 10 and the circuit board CB1. The occurrence of cracks in the solder at the connection portion between the circuit board CB1 and the mounting portion 53 can be suppressed. In this way, when the connector 10 is connected to the connection object 60, the connector 10 can maintain reliable connection.

Because the connector 10 includes the second wide portions 55 configured as wide portions of the contacts 50, the connector 10 can improve product assembly. Because the second wide portions 55 are formed to be wide, the rigidity of the second wide portions 55 is increased. This enables the contacts 50 to be stably inserted from below into the first insulator 20 and the second insulator 30 by an assembling machine or the like, with the second wide portions 55 serving as supports.

The fitting brackets 40*a* are press-fitted into the first insulator 20, and the mounting portions 41*a* are soldered to the circuit board CB1, whereby the fitting brackets 40*a* can stably fix the first insulator 20 to the circuit board CB1. The fitting brackets 40*a* improve the mounting strength of the first insulator 20 on the circuit board CB1.

By attaching the shielding member 40*b* to the first insulator 20, the strength of the connector 10 in the front-rear and left-right directions is increased. Because the shielding member 40*b* includes the raised portions 47*b*, the rigidity of the shielding member 40*b* itself is increased and, as a result, the strength of the connector 10 in the front-rear and left-right directions is also increased.

By attaching the shielding member 40*b* to the first insulator 20, an electrical adverse effect caused by external noise in the front-rear and left-right directions of the connector 10 is suppressed. For example, because noise such as magnetism flowing from the outside to the connector 10 is reduced, an electrical adverse effect on a large capacity and high speed signal transmitted by the contacts 50 is suppressed. Conversely, because noise such as magnetism flowing out of the connector 10 to the outside is reduced, an electrical adverse effect on the electronic components mounted in the vicinity of the connector 10 by the signal transmitted by the contact 50 is suppressed. For example, malfunction of the electronic components in the vicinity of the connector 10 is suppressed.

It will be apparent to those who are skilled in the art that the present disclosure may be realized in forms other than the embodiment described above, without departing from the spirit and the fundamental characteristics of the present disclosure. Accordingly, the foregoing description is merely illustrative and not limiting in any manner. The scope of the present disclosure is defined by the appended claims, not by the foregoing description. Among all modifications, those within a range of the equivalent to the present disclosure shall be considered as being included in the present disclosure.

For example, the shape, the arrangement, the orientation, and the number of each of the constituent elements described above are not limited to the above description and illustrated in the drawings. The shape, arrangement, orientation, and the number of each of the constituent elements may be appropriately determined to be able to realize its function.

The assembly method of the connector 10 and the connection object 60 is not limited to the above description. Any assembly method of the connector 10 and the connection object 60 that enables the connector 10 and the connection object 60 to realize the respective functions may be employed. For example, at least one of the fitting brackets 40*a*, the shielding member 40*b*, and the contacts 50 may be integrally formed with the first insulator 20 or the second insulator 30 by insert molding, instead of press-fitting.

Although it has been described that the first wide portions 51*a* and the second wide portions 55 are formed along the first insulator 20 and the second insulator 30, respectively, this is not restrictive. As long as the transmission characteristic of the connector 10 is maintained, the wide portions may be formed along the corresponding one of the first insulator 20 and the second insulator 30.

Although it has been described that in the intermediate portion 54*b* the width of the transmission path, i.e., the cross-sectional area of the transmission path is increased and the characteristic impedance is reduced and whereby the electrical conductivity is improved, the configuration of the intermediate portion 54*b* for improving the electrical conductivity is not limited thereto. The intermediate portion 54*b* may have any configuration that improves the electrical conductivity. For example, the intermediate portion 54*b* may be formed thicker than the first elastic portion 54*a* while maintaining the same width. For example, the intermediate portion 54*b* may be made of a material having higher electrical conductivity than the first elastic portion 54*a* while maintaining the same cross-sectional area. For example, the intermediate portion 54*b* may have the surface plated for improving the electrical conductivity while maintaining the same cross-sectional area as the first elastic portion 54*a*.

Although it has been described that in the intermediate portion 54*b* the cross-sectional areas of the first adjustment portion 54*b*1, the second adjustment portion 54*b*2, and the third adjustment portion 54*b*3 are sequentially varied in order to adjust the electrical conductivity, the configuration of the intermediate portion 54*b* is not limited thereto. The intermediate portion 54*b* may have any configuration that includes a high electrical conductivity portion, a low electrical conductivity portion, and a high electrical conductivity portion arranged sequentially from the fitting side. For example, in the intermediate portion 54*b*, as described above, the electrical conductivity may be adjusted by varying at least one of the width, the thickness, the cross-sectional area, the material, and the type of plating.

Figure 16A:
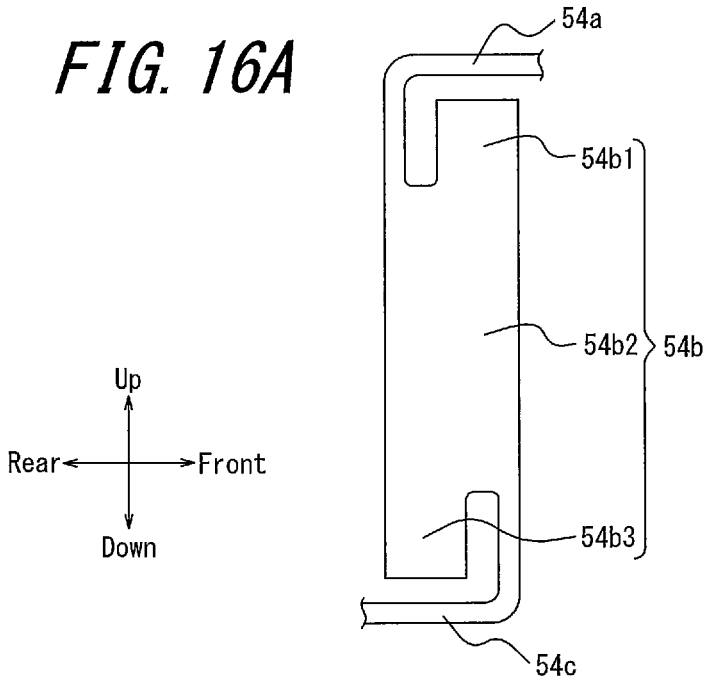
FIG. 16A is a schematic diagram illustrating a first example of a shape of an intermediate portion of the contact.
Figure 16B:
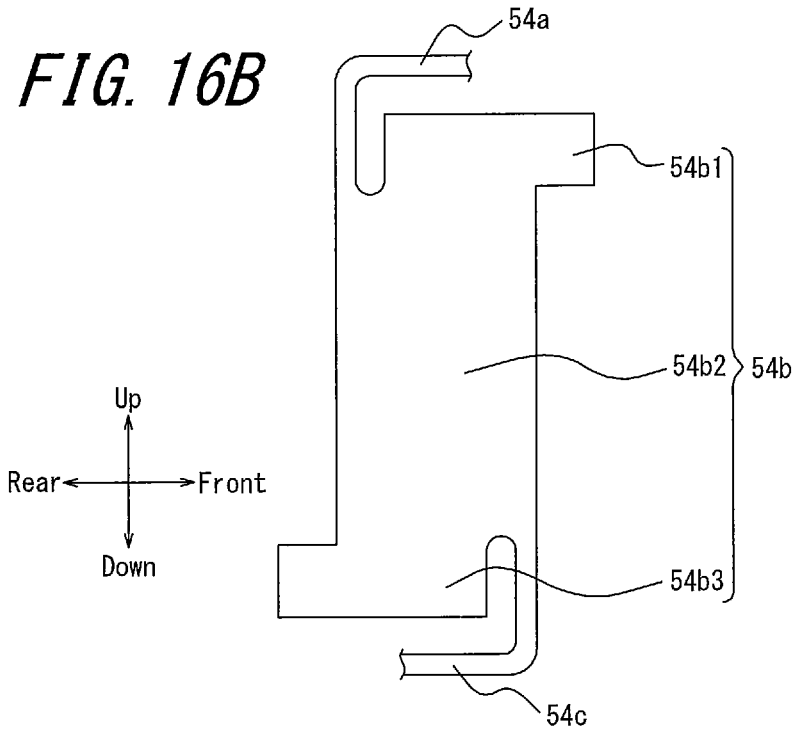
FIG. 16B is a schematic diagram illustrating a second example of the intermediate portion of the contact.
Figure 16C:
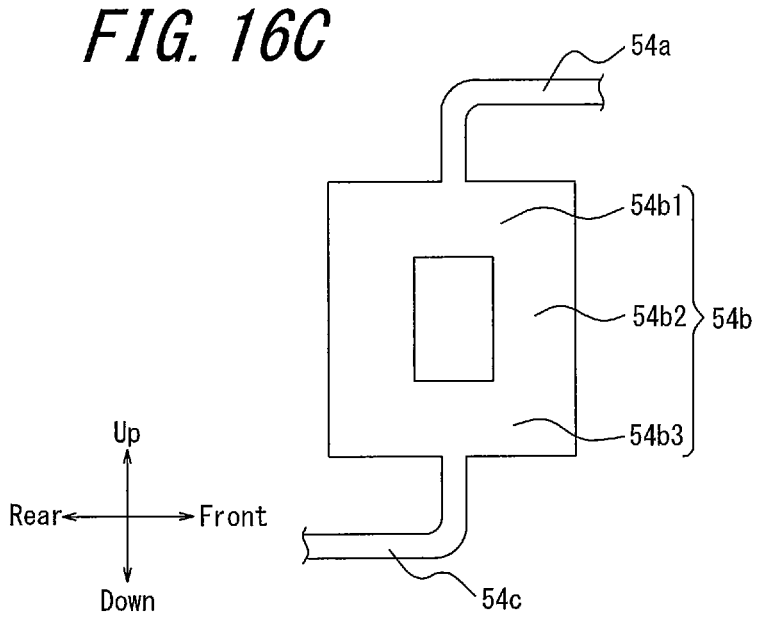
FIG. 16C is a schematic diagram illustrating a third example of the shape of the intermediate portion of the contact.
Figure 16D:
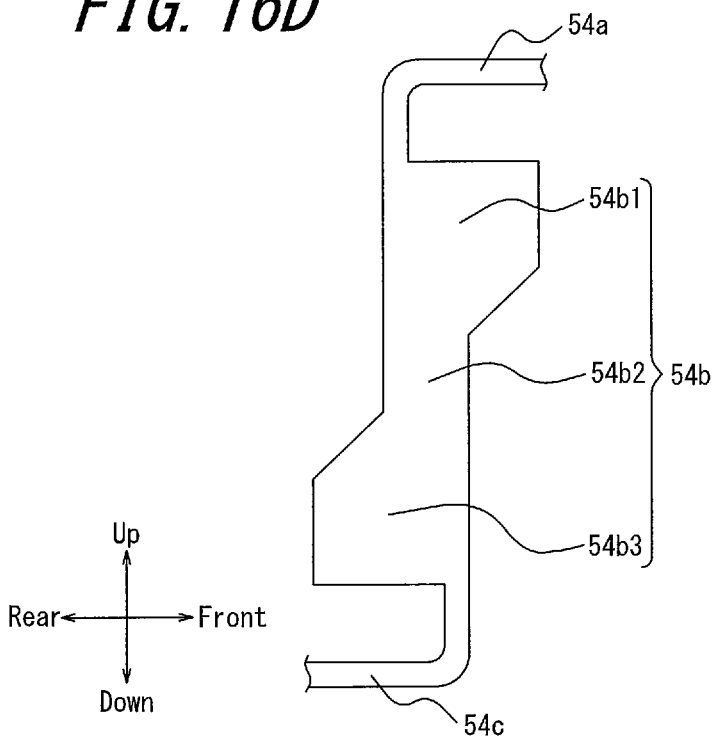
FIG. 16D is a schematic diagram illustrating a fourth example of the shape of the intermediate portion of the contact.

FIG. 16A is a schematic diagram illustrating a first example of a shape of the intermediate portion 54*b* of each of the contacts 50. FIG. 16B is a schematic diagram illustrating a second example of the shape of the intermediate portion 54*b* of each of the contacts 50. FIG. 16C is a schematic diagram illustrating a third example of the shape of the intermediate portion 54*b* of each of the contacts 50. FIG. 16D is a schematic diagram illustrating a fourth example of the shape of the intermediate portion 54*b* of each of the contacts 50.

The shape of the intermediate portion 54*b* is not limited to those illustrated in FIG. 9. The intermediate portion 54*b* may have any shape capable of realizing the function described above. For example, the intermediate portion 54*b* may have the shapes as illustrated in FIG. 16A to FIG. 16D. In the intermediate portion 54*b* illustrated in FIG. 16A, the first adjustment portion 54*b*1 protrudes upward from the second adjustment portion 54*b*2, and the third adjustment portion 54*b*3 protrudes downward from the second adjustment portion 54*b*2. In the intermediate portion 54*b* illustrated in FIG. 16B, the first adjustment portion 54*b*1 protrudes upward from the second adjustment portion 54*b*2 and, simultaneously, protrudes as a step along the front-rear direction from the second adjustment portion 54*b*2. The third adjustment portion 54*b*3 protrudes downward from the second adjustment portion 54*b*2 and, simultaneously, protrudes as a step along the front-rear direction from the second adjustment portion 54*b*2. In FIG. 16C, the intermediate portion 54*b* is formed in a rectangular shape in its entirety and has an opening at the center thereof. In FIG. 16D, the intermediate portion 54*b* tapers from the first adjustment portion 54*b*1 to the second adjustment portion 54*b*2 and becomes wider from the second adjustment portion 54*b*2 toward the third adjustment portion 54*b*3.

It has been described that the intermediate portions 54*b* extend in the fitting direction to be fitted to the connection object 60 in a state in which the first elastic portions 54*a* and the second elastic portions 54*c* are not elastically deformed, and the first elastic portions 54*a* and the second elastic portions 54*c* extend from the respective fitting-direction end portions. However, this is not restrictive. The first elastic portions 54*a*, the intermediate portions 54*b*, and the second elastic portions 54*c* can be in any shape overall that can contribute to the miniaturization of the connector 10 while securing the necessary moving amount of the second insulator 30. For example, the intermediate portions 54*b* may extend in a manner that deviates from the fitting direction. For example, the first elastic portions 54*a* and the second elastic portions 54*c* may extend from the respective end portions of the intermediate portions 54*b* in the front-rear direction of FIG. 7. For example, the first elastic portions 54*a* and the second elastic portions 54*c* may have any shapes with more bent portions. For example, the first elastic portions 54*a*, the intermediate portions 54*b*, and the second elastic portions 54*c* may form an approximate U-shape overall, instead of an approximate crank-shape.

Although it has been described that the first elastic portions 54*a*, the intermediate portions 54*b*, and the second elastic portions 54*c* are sequentially arranged from the fitting side along the fitting direction as illustrated in FIG. 8, this is not restrictive. The first elastic portions 54*a*, the intermediate portions 54*b*, and the second elastic portions 54*c* may be sequentially arranged from the opposite side when they can contribute to the miniaturization of the connector 10 while securing the necessary moving amount of the second insulator 30.

Although it has been described that the first elastic portions 54*a* and the second elastic portions 54*c* are formed to be narrower than the bases 51, this is not restrictive. The first elastic portions 54*a* and the second elastic portions 54*c* may have any configuration that can secure the respective necessary elastic deformation amounts. For example, the first elastic portions 54*a* or the second elastic portions 54*c* may be made of a metal material having a smaller elastic modulus than the other portions of the contacts 50.

Provided that the connector 10 is able to contribute to the miniaturization of the connector 10 while securing a necessary moving amount of the second insulator 30, the connector 10 does not need to include the second elastic portions 54*c* and the third elastic portions 56.

Although it has been described that the wall 36 extends downward from the bottom surface of the fitting recess 33 within the contacts 50, this is not restrictive. For example, provided that the wall 36 is able to prevent contact between the pair of contacts 50, the wall 36 may be formed at a position facing the second wide portions 55 alone.

In a case where the third elastic portions 56 can contribute to the movement of the second insulator 30 in a state in which the engagement of the latches 58 and the contact of the elastic contact portions 59 are stable, the connector 10 does not need to include the notches 57.

Although the contacts 50 have been described as being made of a metal material having a small elastic modulus, this is not restrictive. The contacts 50 may be made of any metal material having any elastic modulus that can secure the necessary elastic deformation amount.

Although the contacts 50 have been described as including the concave-convex portions 51*b* including the concave portion and the convex portion, this is not restrictive. The contacts 50 may include a convex portion alone instead of the concave-convex portions 51*b*.

Figure 17:
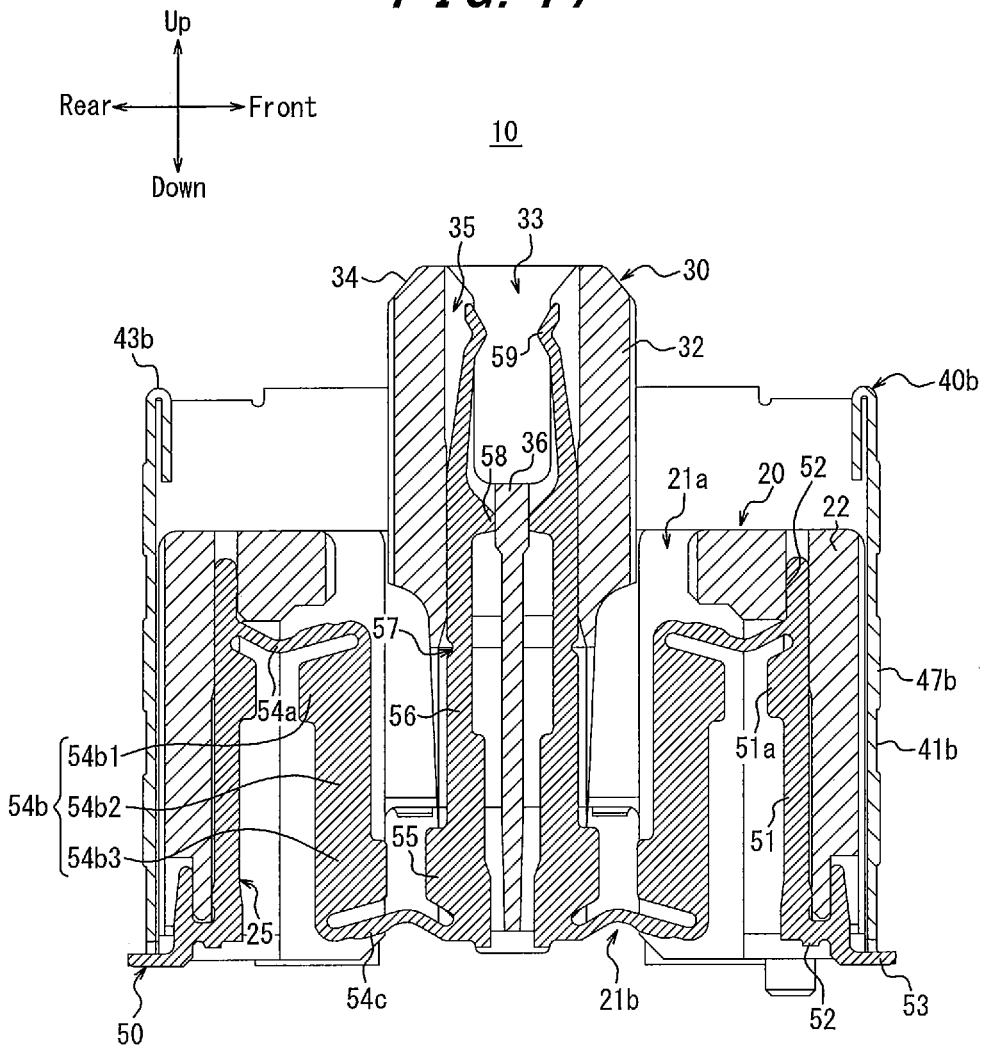
FIG. 17 is a cross-sectional view corresponding to FIG. 7 that illustrates a cross-sectional shape of a contact according to a first example variation.
Figure 18:
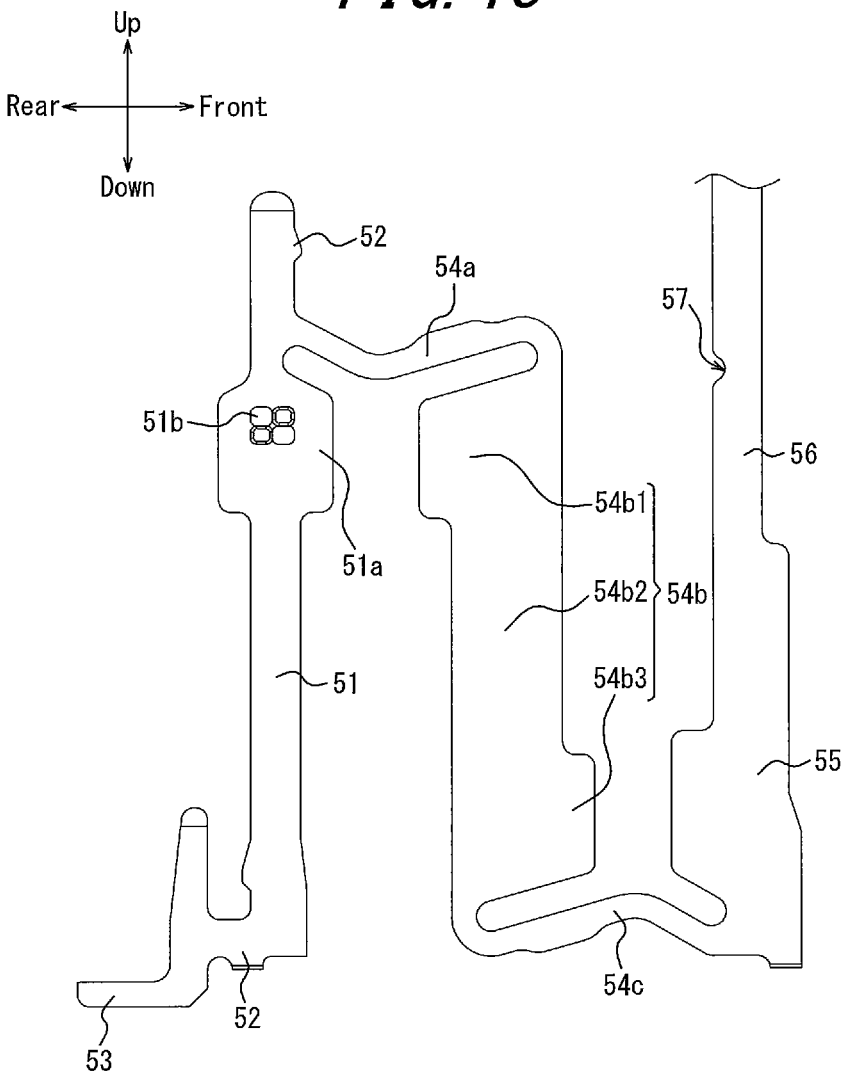
FIG. 18 is an enlarged view corresponding to FIG. 9 that illustrates an enlarged portion of a contact according to a second example variation.

FIG. 17 is a cross-sectional diagram corresponding to FIG. 7 that illustrates a cross-sectional shape of the contacts 50 according to a first example variation. FIG. 18 is an enlarged view corresponding to FIG. 9 that illustrates an enlarged portion of the contact 50 according to a second example variation.

As illustrated in FIG. 17, the second wide portions 55 of the contacts 50 may further protrude toward the second insulator 30 in the direction substantially orthogonal to the arrangement direction of the contacts 50 from the other portion of the contacts 50 along the second insulator 30. In particular, the second wide portions 55 may further protrude inward in the front-rear direction from the third elastic portion 56 over a wide region in the up-down direction.

Consequently, the second wide portions 55 become wider in the front-rear direction, and the characteristic impedance of the second elastic portion 54*c* is more effectively lowered. Thus, the increase in the characteristic impedance in the second elastic portion 54*c* is more effectively suppressed as described with reference to FIG. 10. Further, the strength of the second wide portions 55 is further enhanced as the second wide portions 55 become wider, facilitating the product assembly. For example, when the contacts 50 are inserted from the bottoms of the first insulator 20 and the second insulator 30 by an assembling device or the like having the second wide portion 55 serving as a support, stable insertion is realized by the enhancement of the strength of the second wide portions 55. Accordingly, the workability in assembling the connector 10 is improved.

Referring to FIG. 18, in addition to the configuration of the second wide portions 55 of FIG. 17, the first wide portions 51*a* of the contacts 50 can further protrude toward the first insulator 20 in the direction substantially orthogonal to the arrangement direction of the contacts 50 from the other portions of the contacts 50 arranged along the first insulator 20. In particular, the first wide portions 51*a* may further protrude outward as a step in the front-rear direction from the other portions of the bases 51.

As a result, the first wide portions 51*a* become wider in the front-rear direction, and the characteristic impedance of the first elastic portions 54*a* is more effectively lowered. Thus, the increase in the characteristic impedance in the first elastic portions 54*a* is more effectively cancelled as described with reference to FIG. 10.

As described above, at least one of the first wide portions 51*a* and the second wide portions 55 may further protrude toward the insulator on which each wide portion is located, as illustrated in FIG. 17 and FIG. 18 by way of example.

The concave-convex portions 51*b* of the contacts 50 are not limited to the configuration described above. The concave-convex portions 51*b* may have any configuration that can suppress the twisting of the contacts 50 in the left-right direction. As illustrated in FIG. 18, for example, the concave-convex portions 51*b* may be formed by subdividing a portion of the surface of the first wide portion 51*a* into four regions in the front-rear and left-right directions and arranging the concave and convex region alternately in the front-rear and up-down directions.

Although the connection object 60 has been described as a receptacle connector connected to the circuit board CB2, this is not restrictive. The connection object 60 may be any object other than a connector. For example, the connection object 60 may be an FPC, a flexible flat cable, a rigid board, or a card edge of any circuit board.

The connector 10 described above is mounted in an electronic device. The electronic device includes, for example, any in-vehicle device such as a camera, a radar, a drive recorder, or an ECU (engine control unit). The electronic device includes any in-vehicle device used in an in-vehicle system such as a GPS navigation system, an advanced driving support system, or a security system. The electronic device includes, for example, any information device such as a personal computer, a copy machine, a printer, a facsimile, or a multifunction machine. The electronic equipment also includes any industrial equipment.

Electronic devices as described above have excellent transmission characteristics for signal transmission. Because the floating structure of the connector 10 accommodates the positional displacement between the circuit boards in an excellent manner, the workability at the time of assembling the electronic devices is improved. The electronic devices can be easily manufactured. Because the connector 10 inhibits damage to the connection portion between the connector 10 and the circuit board CB1, the reliability of the electronic device as a product is improved.

REFERENCE SIGNS LIST

10 connector
20 first insulator (insulator)
21*a*, 21*b* opening
22 outer peripheral wall
23 fitting bracket attachment groove
24 engaging portion
25 contact attachment groove
30 second insulator (insulator)
31 bottom portion
32 fitting projection
33 fitting recess
34 guiding portion
35 contact attachment groove
36 wall
40*a* fitting bracket
41*a* mounting portion
42*a* continuous portion
43*a* retainer portion
44*a* latch
40*b* shielding member
41*b* first shielding portion
42*b* second shielding portion
43*b* first bending portion
44*b* second bending portion
45*b* engaging portion

46*b* mounting portion
47*b* protruding portion
50, 50*a*, 50*b* contact
51 base
51*a* first wide portion (wide portion)
51*b* concave-convex portion
52 latch
53 mounting portion
54*a* first elastic portion (elastic portion)
54*b* intermediate portion
54*b*1 first adjustment portion
54*b*2 second adjustment portion
54*b*3 third adjustment portion
54*c* second elastic portion (elastic portion)
55 second wide portion (wide portion)
56 third elastic portion
57 notch
58 latch
59 elastic contact portion
60 connection object
70 insulator
71 fitting recess
72 fitting projection
73 guiding portion
74 engaging portion
75 attachment groove
76 contact attachment groove
80*a* fitting bracket
81*a* mounting portion
82*a* latch
80*b* shielding member
81*b* first shielding portion
82*b* second shielding portion
83*b* engaging portion
84*b* mounting portion
85*b* protruding portion
90 contact
91 mounting portion
92 contact portion
CB1, CB2 circuit board

The invention claimed is:

1. A connector to be fitted to a contact object, the connector comprising:
a first insulator;
a second insulator movable relative to said first insulator; and
a plurality of arranged contacts attached to said first insulator and said second insulator,
wherein each of said contacts includes:
a wide portion located on at least one of a first insulator side and a second insulator side;
an elastic portion that is elastically deformable and is formed continuously with said wide portion; and
an intermediate portion formed continuously with said elastic portion, wherein said intermediate portion includes:
a first adjustment portion protruding in said intermediate portion along a first extension direction of said elastic portion or a second extension direction of said intermediate portion; and
a second adjustment portion that is formed continuously with said first adjustment portion and is wider in said first extension direction than a width of said elastic portion in said second extension direction orthogonal to said first extension direction, and
wherein said wide portion protrudes from another portion of each of said contacts that extends along one of the first insulator and the second insulator where said wide portion is located toward the other insulator in a direction orthogonal to an arrangement direction of said contacts.

2. The connector according to claim 1, wherein said wide portion is formed on both of said first insulator side and said second insulator side.

3. The connector according to claim 1, wherein said first adjustment portion is wider than said second adjustment portion in said contacts said first extension direction.

4. The connector according to claim 1, wherein each of said contacts includes a third adjustment portion that is formed continuously with said second adjustment portion and has a higher electrical conductivity than said second adjustment portion.

5. The connector according to claim 1,
wherein said elastic portion is continuous with said intermediate portion at an end portion opposite to an end portion continuous with said wide portion.

6. The connector according to claim 1, wherein said wide portion is located along said first insulator and said second insulator.

7. An electronic device comprising said connector according to claim 1.

* * * * *